US008478146B2

(12) United States Patent
Yamauchi

(10) Patent No.: US 8,478,146 B2
(45) Date of Patent: Jul. 2, 2013

(54) DEVELOPING APPARATUS AND IMAGE FORMING APPARATUS

(75) Inventor: Satoru Stephen Yamauchi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 12/942,316

(22) Filed: Nov. 9, 2010

(65) Prior Publication Data

US 2011/0158665 A1 Jun. 30, 2011

(30) Foreign Application Priority Data

Nov. 9, 2009 (JP) ..... 2009-255895

(51) Int. Cl.
*G03G 15/08* (2006.01)
*G03G 15/00* (2006.01)

(52) U.S. Cl.
USPC ..... 399/44; 399/53

(58) Field of Classification Search
USPC ..... 399/44, 53, 256
See application file for complete search history.

(56) References Cited

U.S. PATENT DOCUMENTS

| | | | | |
|---|---|---|---|---|
| 6,389,245 | B2 | 5/2002 | Shida et al. | |
| 7,580,657 | B2 * | 8/2009 | Tateyama et al. | 399/256 |
| 2001/0043818 | A1 | 11/2001 | Shida et al. | |
| 2008/0317514 | A1 * | 12/2008 | Fujishima | 399/286 |

FOREIGN PATENT DOCUMENTS

| | | | | |
|---|---|---|---|---|
| JP | 53-115233 | A | | 10/1978 |
| JP | 55-32060 | A | | 3/1980 |
| JP | 62-127776 | A | | 6/1987 |
| JP | 63-177178 | A | | 7/1988 |
| JP | 04198967 | A | * | 7/1992 |
| JP | 6-19293 | A | | 1/1994 |
| JP | 11-344861 | A | | 12/1999 |
| JP | 2000-47476 | A | | 2/2000 |
| JP | 2003-167480 | A | | 6/2003 |
| JP | 2006-267194 | A | | 10/2006 |
| JP | 2007-65581 | A | | 3/2007 |

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

A developing apparatus includes a developer container, a developer carrying member for feeding developer to a position opposing an image bearing member to develop a latent image formed on the image bearing member; a first chamber, provided in the container, for supplying developer to the carrying member; a second chamber, provided adjacent to the first chamber; a first feeding member, provided in the first chamber, for feeding developer; a second feeding member, provided in the second chamber, for feeding developer in a direction opposite to a feeding direction of the first feeding member; a partition member provided between the first and second chambers; an opening provided in each of opposite ends of the partition member; and a sensor, provided between the first and second feeding members at a position facing one of the partition openings, for detecting information relating to temperature or moisture of developer in the container.

3 Claims, 12 Drawing Sheets

(A)

(B)

(A)

(B)

(A)

(B)

DEVELOPING APPARATUS AND IMAGE FORMING APPARATUS

FIELD OF THE INVENTION AND RELATED ART

The present invention relates to a developing apparatus and an image forming apparatuses equipped with a developing apparatus. In particular, it relates to those apparatuses structured to develop an electrostatic latent image on their image bearing member(s), with the use of dry developer.

A conventional image forming apparatus, such as a printer and a facsimile, is structured to form an electrostatic latent image on its image bearing member, develop the electrostatic latent image into a visible image with its developing apparatus, and then, transfer the visible image onto a sheet of recording medium to yield a copy (print). As the developing apparatus, there have been proposed developing apparatuses which use two-component developer, that is, developer formed by mixing magnetic carrier and nonmagnetic toner in a preset ratio. These developing apparatuses have been known to develop an electrostatic latent image into a visible image through the following steps: dry developer (as agent for developing electrostatic latent image into visible image) is borne on the peripheral surface of the developer bearing member of the developing apparatus; and the developer on the peripheral surface of the developer bearing member is conveyed to the adjacencies of the peripheral surface of an image bearing member, while alternating voltage is being applied between the image bearing member and developer bearing member. Incidentally, most of these developing apparatuses use a development sleeve as their developer bearing member. Hereafter, therefore, a developer bearing member may be referred to as a "development sleeve". Further, the image bearing member employed by most of the image forming apparatuses is a photosensitive drum. Hereafter, therefore, the image bearing member may be referred to as a "photosensitive drum".

The structure of the developing apparatuses described above, and the development process carried out by them, are as follow. The developing apparatuses are provided with a development sleeve which has a magnet, as a magnetic field generating means, in its follow. They are positioned so that there is only a minute gap (development gap) between their development sleeve and the corresponding photosensitive drum. As the development sleeve is rotated, a magnetic brush is formed on the peripheral surface of the development sleeve, of developer (two component developer) which is a mixture of carrier particles and toner particles), while toner particles become charged. As the development sleeve is rotated further, the magnetic brush is moved into the development gap between the development sleeve and photosensitive drum, coming into contact with, or virtually in contact with, the peripheral surface of the photosensitive drum, while alternating voltage is applied between the development sleeve and photosensitive drum (S-D gap). Thus, the toner particles are made to move back and forth between the development sleeve and photosensitive drum. Consequently, the electrostatic latent image on the peripheral surface of the photosensitive drum is developed by the toner particles (development by magnetic brush) (Japanese Laid-open Patent Application S55-32060).

By the way, in the case of an image forming apparatus such as those described above, it is important that toner particles are provided with a proper amount of charge (triboelectricity). It has been known that the amount by which the toner particles in two-component developer are charged by friction (given triboelectricity) is likely to be affected by ambient temperature and humidity for the following reasons. That is, as the toner particles in two-component developer come into contact with the magnetic particles (carrier particles) in the two-component developer, they become frictionally charged. Thus, as the ambience of dry developer changes in humidity, the amount by which moisture adheres to the toner particle surface changes, which in turn changes the amount by a toner particle can hold triboelectricity. This change in the amount of triboelectric charge which each toner particle holds sometimes causes an image forming apparatus to change in the level of density at which the apparatus outputs images. On the other hand, it is very difficult to accurately detect the changes in the amount of toner charge. Thus, in order to ensure that an image forming apparatus is operated under proper conditions to output images which are proper in density, the environment in which the image forming apparatus is operated has to be continuously monitored to detect the changes in the environment to predict the changes in the amount of the electrical charge of the toner, so that the image forming apparatus can be properly adjusted in setting as necessary for the formation of satisfactory images.

The need for this adjustment is even greater for a color image forming apparatus. Thus, it has been proposed to create an image forming apparatus capable of adjusting itself in response to the changes in the environment in which it is operated. For example, there has been proposed an image forming apparatus which is controlled so that it detects the relative humidity within the apparatus and adjusts itself in image formation settings in response to the detected relative humidity (Japanese Laid-open Patent Application S53-115233). There has also been proposed an image forming apparatus which is controlled so that it detects the absolute humidity (amount of moisture per unit volume) and adjusts itself in image formation settings in response to the detected absolute humidity (Japanese-Laid-open Patent Application S63-177178).

On the other hand, as a means for detecting the amount of toner (toner density) in developer, it is possible to provide a developer container with a magnetic permeability detection sensor. However, as the toner particles in developer change in the amount of electric charge, the developer particles change in the amount of force by which they repel among themselves, and therefore, the developer changes in the particle gap, that is, it increases in apparent density, which causes the developer to change in apparent magnetic permeability. In other words, it is possible that the amount of toner in developer detected by providing a developer container with a magnetic permeability sensor may not be accurate.

As described above, the changes in the amount of toner charge is sometimes attributable to the changes which occur to developer itself. However, developer is in a developer container, which is structured to be highly airtight. The developer in a developer container is extremely insensitive to the changes in the ambience of an image forming apparatus, compared to the developer which is not in a developer container. This is why it is difficult to accurately detect the amount of changes which occurred to the developer in the developer container, with the use of a detecting means placed outside the developer container. Further, in recent years, image forming apparatuses of the tandem type have been developed to deal with the public demand for image forming apparatuses which are substantially higher in operational speed than conventional ones. In the case of these image forming apparatuses, the developing apparatus which is nearest to the fixing apparatus of the image forming apparatus, and the farthest developing apparatus from the fixing apparatus, are likely to be different in the extent to which they are affected by the heat from the fixing apparatus. In other words, the developing apparatuses in an image forming apparatus of the tandem type are likely to become different in temperature.

On the other hand, the recent technological advancement began to bring to general market such a small sensor that is represented by a temperature-humidity sensor SHT1X (product of Sensirion Co., Ltd). Thus, it has been proposed to detect the absolute amount of moisture, or absolute humidity, in the dry developer in the developer container, by placing a small temperature-humidity sensing means, such as the above-described one, in each developer container to accurately detect the changes which have occurred to the developer in the developer container due to the changes in the internal ambience of the developer container, and feed the detected absolute amount of moisture, or absolute humidity, back to the process for determining the settings for the developing apparatus(es). For example, there has been known an image forming apparatus structured to position an environment sensor so that the sensor contacts the body of developer in a developer container, at the bottom of the container, and controls the length of time the developer is stirred based on the changes in the temperature and humidity detected by the environment sensor, to keep the toner stable in the amount of triboelectric charge (Japanese Laid-open Patent Application 2007-65581). There has also been known an image forming apparatus structured to position a temperature-humidity sensor so that the sensor contacts the body of developer in the developer container, at the side wall of the container, and adjusts in value the signals from the magnetic permeability sensor, based on the changes in temperature and/humidity detected by the temperature-humidity sensor (Japanese Laid-open Patent Application 2000-47476).

However, in the case of the image forming apparatuses structured as disclosed in Japanese Laid-open Patent Applications 2007-65581, and 2000-47476, the environment sensor (temperature-humidity sensor) is at the bottom and side wall, respectively, and therefore, it is difficult to accurately detect the changes which occurred to the developer due to the changes in its ambience. Further, it became evident from the studies made by the inventors of the present invention that unless it is where developer flows that an environment sensor is placed, the temperature and humidity levels, which reflect the changes which occurred to the developer due to the changes in the ambience of the developer, cannot be accurately detected. Therefore, in the case of the image forming apparatuses disclosed in Japanese Laid-open Patent Applications 2007-65581 and 2000-47476, which are structured as described above, the changes which occurred to the developer due to the changes in the ambience of the developer cannot be accurately detected. Incidentally, even if an environment sensor is placed in the area of the internal space of a developer container, in which the developer does not come into contact with the sensor, the changes which occurred to the developer due to the changes in the ambience of the developer cannot be accurately detected because of the adiabatic effect of the air.

SUMMARY OF THE INVENTION

Thus, the primary object of the present invention which was made in consideration of the above-described matters is to provide a developing apparatus capable of accurately detecting the changes which occurred to the developer in its developer container due to the changes in the ambience of the developer, and an image forming apparatus equipped with such a developing apparatus.

According to an aspect of the present invention, there is provided a developing apparatus comprising a developing container for accommodating a developer; a rotatable developer carrying member, provided in an opening of said developing container, for feeding the developer to a position opposing image bearing member to develop a latent image formed to said image bearing member; a first chamber, provided in said developing container, for supplying the developer to said developer carrying member; a second chamber, provided adjacent to said first chamber in said developing container, for accommodating the developer; a first feeding member, provided in said first chamber, for feeding the developer in said first chamber; a second feeding member, provided in said second chamber, for feeding the developer in a direction opposite to a feeding direction of said first feeding member; a partition member partitioning between said first chamber and said second chamber; an opening provided in each of opposite ends of said first chamber to form a circulation path between said first chamber and said second chamber; and detecting means, provided opposed to said opening at a position contacting said developer, for detecting a temperature or humidity for controlling an image forming condition.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

<Example of Image Forming Apparatus>

Figure 1:
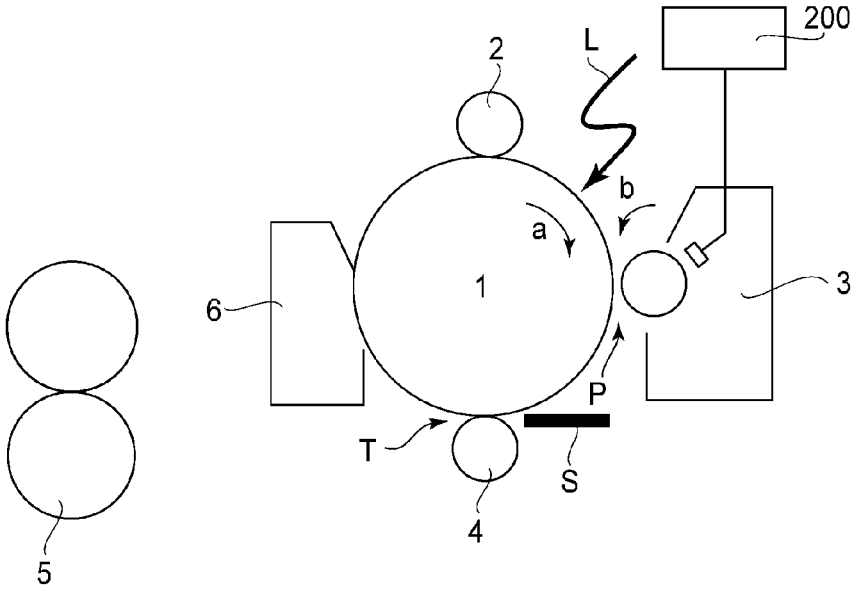
FIG. 1 is a schematic sectional view of an example of image forming apparatus in accordance with the present invention.
Figure 2:
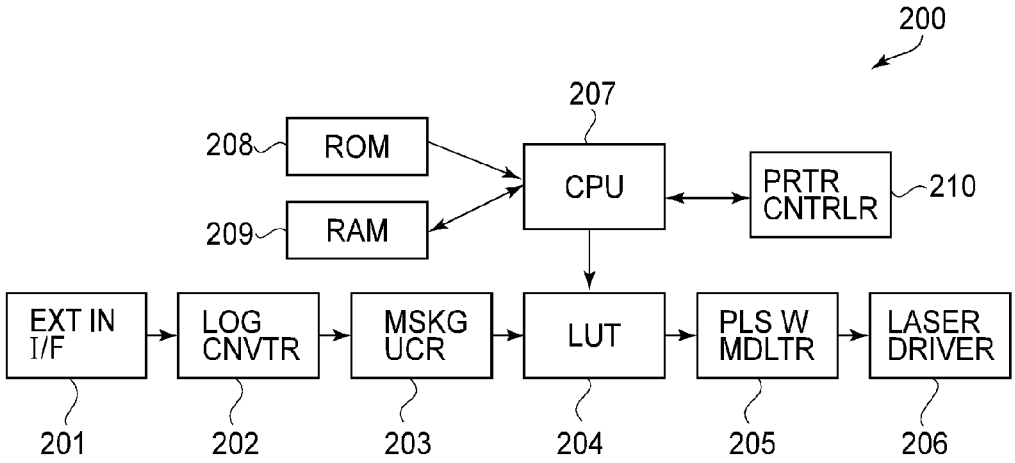
FIG. 2 is a block diagram of the operational sequence of the image processing system of the image forming apparatus shown in FIG. 1.

First, referring to FIGS. 1 and 2, an example of image forming apparatus to which the present invention is applicable is described. Referring to FIG. 1, designated by a referential code 1 is a photosensitive drum as an image bearing member. Designated by a referential code 2 is a primary charging device, which is in the form of a roller (charge roller) or the like. The charge roller 2 is in the adjacencies of the peripheral surface of the photosensitive drum 1, and uniformly charges the peripheral surface of the photosensitive drum 1. Designated by a referential code 3 is a developing apparatus which develops an electrostatic latent image formed on the peripheral surface of the photosensitive drum 1 (image bearing member) by exposing the uniformly charged portion of the peripheral surface of the photosensitive drum 1 with the beam M of laser light projected from an unshown laser-based exposing device. Designated by a referential code 4 is a transfer roller which forms a transfer portion T in cooperation with the photosensitive drum 1. Designated by a referential code 5 is a fixing device which fixes a toner image on a sheet S of recording medium. Designated by a referential code 6 is a cleaner which removes the residual toner on the peripheral surface of the photosensitive drum 1 after the transfer of the toner image.

Described next is the image forming operation of the image forming apparatus structured as described above. As the image forming operation is started, first, the photosensitive drum 1 begins to be rotated in the direction indicated by an arrow mark a. As the photosensitive drum 1 is rotated, the peripheral surface of the photosensitive drum 1 is uniformly charged by the primary charging device 2. Then, the uniformly charged portion of the peripheral surface of the photosensitive drum 1 is exposed by the laser-based exposing apparatus. Consequently, an electrostatic latent image is formed on the peripheral surface of the photosensitive drum 1. Next, the process for forming an electrostatic latent image, that is, the process for exposing the peripheral surface of the photosensitive drum 1 with the beam L of laser light from the laser-based exposing device is described in detail.

FIG. 2 is a block diagram of the image processing unit of the control portion 200, which is the controlling means for controlling the image formation settings for the image forming apparatus in FIG. 1, and shows the structure of the system (unit). Referring to FIG. 2, designated by a referential code 201 is an external input interface (I/F), through which color image data (R, G, and B data) is inputted into the image forming apparatus from an unshown external apparatus, such as a scanner (for scanning original), a computer (information processing apparatus), etc. Designated by a referential code 202 is a LOG converting portion, which converts brightness data of the R, B and G data inputted based on the look-up-table (LUT) made up of the data or the like in a ROM 208, into the density data for the C, M and Y monochromatic images (CMY image data). Designated by a referential code 203 is a masking/UCR portion, which extracts black (Bk) component data from the CMY data, and subjects the C, M, Y and K data to the matrix computation, to compensate for the effects of the color of recording medium upon the image to be formed on the recording medium. Designated by a referential code 204 is a look-up-table (LUT) which is used for making adjustments to each of the CMYK data inputted using a gamma look-up-table (γ look-up-table) to match the image data with the ideal toner properties of the printing portion. Incidentally, the γ look-up table is created based on the data developed in a RAM 209, and its contents are set by a CPU 207. Designated by a referential code 205 is a pulse width modulating portion, which outputs pulse signals, the pulse width of which corresponds to the levels of image data (image signals) inputted based on the LUT portion 204. It is based on these pulse signals that a laser driver 206 drives a laser. As the laser is driven, the uniformly charged portion of the peripheral surface of the photosensitive drum 1 is illuminated (exposed) by the beam of laser light projected from the laser. Consequently, an electrostatic latent image is formed on the peripheral surface of the photosensitive drum 1. Incidentally, a printer control portion 210 controls image formation settings other than the above-described settings. For example, it controls development contrast.

The electrostatic latent image formed through the above-described processes is developed into a visible image, that is, an image formed of toner (which hereafter may be referred to simply as toner image) by a developing apparatus 3 which uses two-component developer which is made up of magnetic carrier and nonmagnetic toner. The thus obtained toner image is transferred by a transfer. roller 4 onto the sheet S of recording medium conveyed to the transfer portion T. After the transfer of the toner image onto the sheet S of recording medium, the sheet S is conveyed to the fixing device 5, in which the toner image is fixed to the sheet S. After the fixation of the toner image, the sheet S is discharged from the image forming apparatus. The transfer residual toner, that is, the toner remaining adhered to the peripheral surface of the photosensitive drum 1 after the transfer of the toner image, is removed by the cleaner 6, so that the cleaned portion of the peripheral surface of the photosensitive drum 1 is used again for image formation.

<Embodiment 1>

Figure 3:
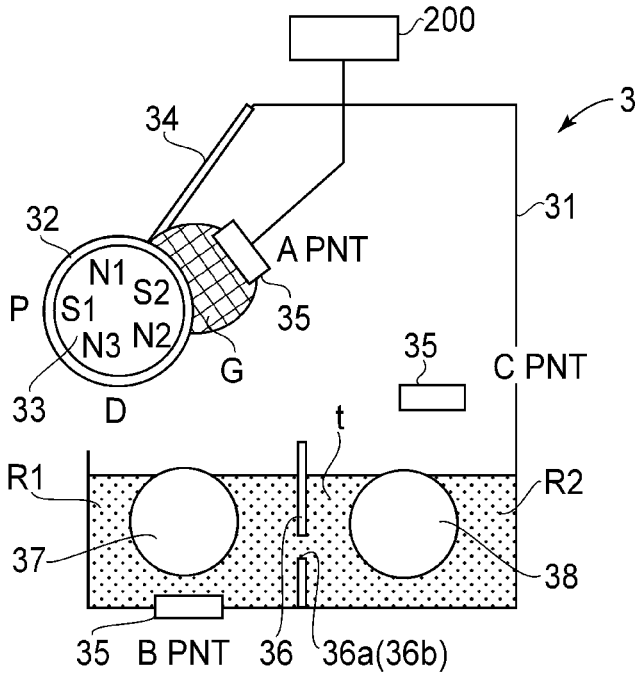
FIG. 3 is a schematic sectional view of the developing apparatus in the first preferred embodiment of the present invention, and shows the structure of the developing apparatus.

Next, the first preferred embodiment of the present invention is described. Referring to FIG. 3 which shows the developing apparatus 3 which is an integral part of the image forming apparatus described above, the developing apparatus 3 which develops an electrostatic latent image has a developer container 31, a development sleeve 32 (developer bearing member), a magnet 33 (multipolar magnet), a regulating blade 34 (developer regulating member), and an environment sensor 35 (detecting means).

Among the above-mentioned portions of the developing apparatus 3, the developer container 1 is a container in which developer t, which is two-component developer which is made up of magnetic carrier and nonmagnetic toner, is stored. It has a development chamber R1 and a developer stirring chamber R2, which are separated from each other by a partition wall 36, that is, a developer container partitioning member which is roughly parallel to the rotational axis of the development sleeve 32. The development chamber R1 is the developer conveyance first passage, and the stirring chamber R2 is the developer conveyance second passage. The development chamber R1 and stirring chamber R2, which oppose each other with the presence of the partition wall 36 between the two chambers, have screws 37 and 38, respectively, which are developer conveying members. The developer t in the developer container 31 is conveyed in the preset direction in the development chamber R1 from the rear side in FIG. 3 toward the front side while being stirred by the screw 37, and then, conveyed in the stirring chamber R2 in the opposite direction from the direction in which it is conveyed in the development chamber R2, that is, from the front side in FIG. 3 toward the rear side, while being stirred by the screw 38. The partition wall 36 is provided with a pair of openings 36*a* and 36*b*, which are at its upstream and downstream ends in terms of the developer conveyance direction. These openings 36*a* and 36*b* are for allowing the developer t to move between the first and second developer conveyance passages. Thus, the developer t is moved from the development chamber R1 into the stirring chamber R2 through one of the two openings 36*a* and 36*b*, and then, is moved from the stirring chamber R2 into the development chamber R1 through the other opening, being thereby circularly moved in the development container 31.

The development sleeve 32 is a cylindrical member made of a nonmagnetic material such as SUS. It is rotatable in the direction indicated by an arrow mark b, and is in such a position that its peripheral surface is virtually in contact with the peripheral surface of the photosensitive drum 1 (FIG. 1). It conveys the developer t. The magnet 33 is a cylindrical and solid one, and is in the hollow of the development sleeve 32 (inside developer bearing member). It is stationary. It has multiple magnetic poles in terms of the rotational direction of the development sleeve 32. It is by the magnetic force of each magnetic pole that the developer t is borne on the peripheral surface of the development sleeve 32 (developer bearing member). In this embodiment, the magnet 33 has five magnetic poles S1, N3, N2, S2 and N1 listing sequentially from the primary development pole S1 in terms of the rotational direction of the development sleeve 32. The developing apparatus 3 is structured so that the axial line of the development sleeve 32 coincides with that of the magnet 33, and also, so that the development sleeve rotates around the stationary magnet 33.

The regulating blade 34 is above the development chamber R1 . Not only does it charge the developer t on the development sleeve 32 as the development sleeve 32 is rotated, but also, regulates the amount by which the developer t is allowed to remain borne by the development sleeve 32 per unit area of the peripheral surface of the development sleeve 32. In terms of the rotational direction of the development sleeve 32, the position of the regulating blade 34 is such that it is on the downstream side of the magnetic pole S2, and also, that the closest distance between the peripheral surface of the development sleeve 32 and the regulating edge of the regulating blade 34 is 400 μm. Although, in this embodiment, a planar nonmagnetic blade was used as the regulating blade 34, a piece of magnetic plate made of a magnetic material may be solidly attached to the bottom surface of the regulating edge portion of the nonmagnetic blade.

The environment sensor 35 is a small temperature-humidity sensor, for example, a temperature-humidity sensor SHT1X (product of Sensirion Co., Ltd). It is used for controlling the image formation settings for forming an electrostatic latent image on the peripheral surface of the photosensitive drum 1. More concretely, referring to FIG. 14, the environment sensor 35 has: an electrostatic capacity sensing element 301 (polymer) as a humidity sensing device; and a band gap temperature sensor 302 as a temperature detecting device. Each of the sensing devices is a CMOS device which is coupled with a 14 bit A/D converter 303 and outputs serial signals through a digital interface 304. As for its electrical properties, Vdd=5 V, and its output is in a range of 20%-100% of Vdd. The static electricity capacity polymer 301 is a condenser, the dielectric component of which is polymer. The principle on which the electrostatic capacity detection polymer 301 is based is as follows: The amount by which moisture adheres to the polymer changes in response to the change in ambient humidity. Further, the electrostatic capacity of the condenser linearly changes in response to the change in humidity. Thus, the amount of humidity is obtained by converting the electrostatic capacity of the condenser into the amount of humidity. As for the band gap temperature sensor 302 as the temperature detection device, a thermistor which linearly changes in electrical resistance in response to the change in temperature is used to obtain temperature by computation from the amount of the electrical resistance of the thermistor.

The environment sensor 35 in this embodiment is desired to be such an environment sensor that is unlikely to be affected by the alternating electric field which is continuously applied between the development sleeve 32 and photosensitive drum 1 to develop an electrostatic latent image on the peripheral surface of the photosensitive drum 1. However, as long as temperature and humidity are detected when the above-mentioned electric field is not applied, a temperature-humidity sensor, such as those described above, can be used as the environment sensor 35.

The environment sensor 35 is in the adjacencies of the peripheral surface of the development sleeve 32. Further, in terms of the rotational direction of the development sleeve 32, it is between the regulating blade 34, and the point of the peripheral surface of the development sleeve 32, at which the developer t remaining on the peripheral surface of the development sleeve 32 after the development of an electrostatic latent image is separated from the development sleeve 32. Further, it is in a developer reservoir which is on the immediate upstream side of the regulating blade 34 in terms of the rotational direction of the development sleeve 32. Where the environment sensors 35 is to be positioned will be described later. In this embodiment, the signals outputted from the environment sensors 35 are sent to the control portion 200, by which the image formation settings are determined based on the developer condition detected by the environment sensors 35.

Next, the system for supplying the photosensitive drum 1 with the developer t with the use of the developing apparatus 3 is described. First, as the developer t in the development chamber 1 is conveyed by the screw 37, a part of the body of developer t is supplied to the development sleeve 3 by the magnetic pole N2 (which is 600 gauss in maximum magnetic flux density, and 35° in half value) of the magnet 33, and is partially borne by the peripheral surface of the development sleeve 32. Then, the developer t on the peripheral surface of the development sleeve 32 is conveyed to the magnetic pole S2 (which is 650 gauss in maximum magnetic flux density, and 48° in half value) and then to the magnetic pole N1 (which is 650 gauss in maximum magnetic flux density, and 50° in half value) by the further rotation of the development sleeve 32. While the developer t on the peripheral surface of the development sleeve 32 is conveyed from where it was picked up by the peripheral surface of the development sleeve 32 to where the magnetic pole S2 is located, it is mechanically and magnetically formed into a uniform thin layer of developer t with a preset thickness, for example, a thin layer of developer t which is roughly 30 mg/cm$^2$, by the coordination of the regulating blade 34 and magnetic pole S2. This thin layer of developer t is conveyed by the further rotation of the development sleeve 32 to a development point P (FIG. 1) where the peripheral surface of the development sleeve 32 comes virtually in contact with the peripheral surface of the photosensitive drum 1.

The magnetic pole S1 (which is 1,050 gauss in magnetic flux density, and 35° in half value) which corresponds in position to the development point P, is the primary development pole. That is, as a given portion of the thin layer of developer t on the peripheral surface of the development sleeve 32 is conveyed to the development point P, it is made to crest by the magnetic pole S1, coming thereby into contact with the peripheral surface of the photosensitive drum 1, while a preset development bias is applied to the development sleeve 32. Thus, only the toner particles in the crest portion of the developer layer are transferred onto the peripheral surface of the photosensitive drum 1, in the pattern of the electrostatic latent image on the peripheral surface of the photosensitive drum 1, by the development bias; a visible image is formed of the toner, on the peripheral surface of the photosensitive drum 1. The development bias is a combination of DC voltage Vdev (V) with a preset value, and AC voltage. The DC component of the development bias is rectangular in waveform, 3 kHz in frequency, and 1.5 kV in peak-to-peak voltage.

As for the residual developer t, that is, the developer t remaining on the peripheral surface of the development sleeve 32 after the development of the electrostatic latent image, is moved through the development point P by the further rotation of the development sleeve 32, and is returned into the developer container 31, reaching the point which corresponds to the location of the magnetic pole N3 (which is 750 gauss in maximum magnetic flux density and is 40° in half value). Then, as the development sleeve 32 is further rotated, the residual developer t falls from the development sleeve 32 while it is conveyed through an area D (where magnetic fields from two magnetic poles N2 and N3 repel each other) between the magnetic poles N3 and N2 where a magnetic density Br at the peripheral surface of the development sleeve 32 in terms of the vertical direction is no more than 50 gauss, for example, and a magnetic flux density Bθ at the peripheral surface of the development sleeve 32 in terms of the horizontal direction is no more than 50 gauss, for example. That is, the area D is where the above-described residual developer t, that is, the developer t remaining on the peripheral surface of the development sleeve 32 after the development the electrostatic latent image, separates from the development sleeve 32. Incidentally, all that is required of the area D is that it is no less than 0 gauss in magnetic flux density in both the vertical and horizontal directions at the peripheral surface of the development sleeve 32, and the two magnetic poles (N2 and N3 in this embodiment) are opposite in polarity. As the residual developer t falls back into the developer container 31 (development chamber R1), it is conveyed rearward in FIG. 3, along with the developer t in the development chamber R1, by the screw 37 which is below the development sleeve 32. Then, as it reaches the rear end of the development chamber R1, it is given to the screw 38 through the opening 36*b* of the partition wall 36, which corresponds in position to the downstream end of the screw 37 in terms of its developer conveyance direction (direction in which developer t is conveyed in first developer conveyance passage).

Not only is the developing apparatus 3 driven for developing an electrostatic latent image on the peripheral surface of the photosensitive drum 1, but also, for stirring the developer t to increase the developer t in the amount of triboelectricity for a preset length of time (developer stirring time) right after the image forming apparatus is turned on. The length of this developer stirring time is set to two minutes, for example.

Next, the two-component developer used in this embodiment is described. The toner is made up of bonding resin, coloring agent, and external additives. The external additives, which are added as necessary, are coloring agent particles which contain additives, coloring particles which contain additives such as microscopic powder of choroidal silica. The toner is made of polyester resin, and is negatively chargeable. It is desired to be no less than 5 μm and no more than 8 μm in volume average particle diameter. The toner used in the experiments which will be described later was 7.0 μm in volume average particle diameter.

As the carrier, metallic substances such as iron, nickel, cobalt, manganese, chrome, rare earth metals, and their alloys, which were oxidized or not oxidized across their surface, or oxides of ferrites, are preferable. It does not matter how the magnetic particles are manufactured of any of these substances. Further, in terms of volume average diameter, the carrier is desired to be in a range of 20-50 μm, preferably, 30-40 μm. In terms of resistivity, it is desired to be no less than $10^7$ Ω·cm, preferably, $10^8$ Ω·cm. The carrier used in the experiments which will be described later was 40 μm in volume average diameter, $5\times10^7$ Ω·cm in resistivity, and 260 emu/cc in amount of magnetization.

The volume average particle diameter of the toner was measured with the use of the apparatus and method which are described next. As the measuring apparatus, a Coulter counter TA-II (product of Coulter Co., Ltd) was used along with an interface (product of Nikkaki: Japan Chemical Engineering & Machinery Co., Ltd.) for outputting the number average distribution and volume average distribution, and a personal computer X-1 (product of Canon). As the electrolyte, 1% water solution of NaCl manufactured of first class sodium was used.

The method for the measurement was as follows: First, 0.1 ml of surfactant, preferably, alkylbenzensulfonate as dispersant was added to 100-150 ml of electrolyte, and then, 0.5-50 mg of the toner sample to be measured was added. Then, the electrolyte in which the toner sample was suspended was processed for roughly 1-3 minutes with an ultrasonic dispersing device to uniformly disperse the sample toner in the electrolyte. Then, the volume average distribution of the sample toner was obtained by measuring the distribution of the particles, which were 2-40 μm in diameter, with the use of the above-mentioned Coulter counter TA-II fitted with a 100

μm aperture. Then, the volume average diameter of the toner sample was obtained from the volume average distribution obtained through the above-described steps.

The resistivity of the carrier was measured with the use of the following method. That is, the carrier sample was placed in a cell of the so-called sandwich type, which was 4 cm in measurement electrode size, and 0.4 cm in electrode gap. Then, the carrier resistivity was obtained from the amount by which electric current flowed through the circuit when a preset voltage E (V/cm) was applied between the two electrodes while 1 kg of weight was applied to one of the electrode.

Next, the experiments carried out to study the amount by which the toner was given triboelectric charge, in order to find the best locations in which temperature-humidity sensors were to be positioned in the developer container 31 in this embodiment is described. In the experiment, first, the developer t was left unattended for a substantial length of time in a low temperature-low humidity environment (23° C. in temperature, 5% in RH, and 0.83 g/m$^3$ in absolute humidity), and a high temperature-high humidity environment (30° C. in temperature, 80% in RH, and 21.6 g/m$^3$ in absolute humidity). Then, after the developer t became absolutely stable in moisture content (humidity), it was placed in a polyester bin. Then, the developer t was measured in the amount of its triboelectricity while shaking the bin. The measured amount of triboelecticity of the developer t was plotted in a graph (FIG. 4) to study the developer t in terms of the triboelectricity increase (study 1).

Figure 5:
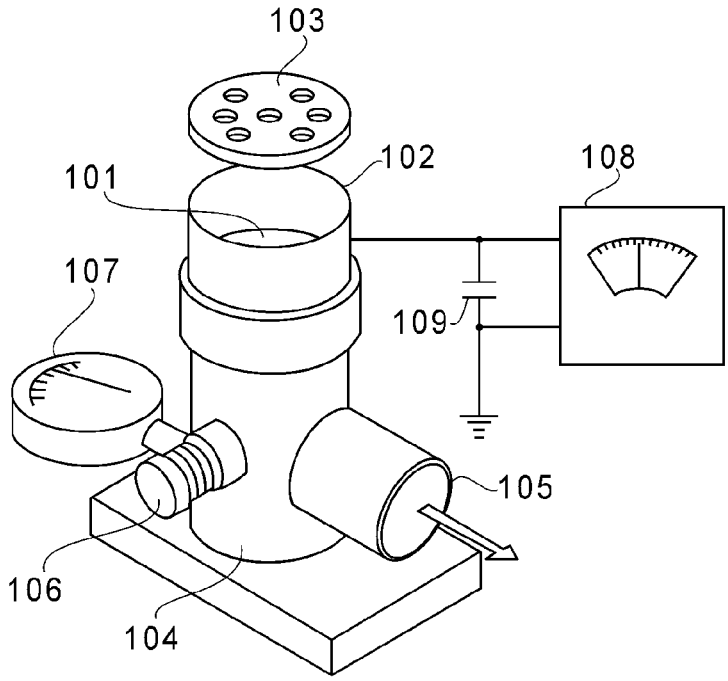
FIG. 5 is a perspective view of the device for measuring the amount of the toner charge, and shows the structure of the device.

At this time, the method used for measuring the amount of triboelectricity (C/kg) of the developer t is described with reference to FIG. 5, which is a perspective drawing of the apparatus used to measure the amount of the triboelectricity of the toner. First, the two-component developer was placed in a polyethylene bin, which was roughly 50-100 ml in volume. Then, the bin was shaken roughly 10-40 seconds by hand. Then, roughly 0.5-1.5 g of the developer from the bin was placed in a metallic measurement container 102, the bottom of which is made of 500 mesh screen, and the container 102 was covered with a metallic lid 103. The weight of the combination of the measurement container 102, developer therein, and lid 103 was W1 (kg). Then, air was drawn through the outlet 105 by a suctioning device 104, while adjusting an air volume control valve 106, so that the amount of pressure shown by a vacuum gauge remains at 250 (mmAg) for a substantial length of time, preferably 2 minutes, to vacuum away the resin particles. The amount of voltage measured by a voltmeter was V (v). Designated by a referential code 109 in FIG. 5 is a condenser, which was C (F) in capacity. Thereafter, the weight W2 (kg) of the combination of the bin 101, developer therein, and lid 103 was measured to calculate the amount (C/kg) of the triboelectricity of the toner, using the following equation:

$$\text{Amount of triboelectricity of resin (C/kg)} = C \times V \times 10-3/(W1-W2)$$

Figure 4:
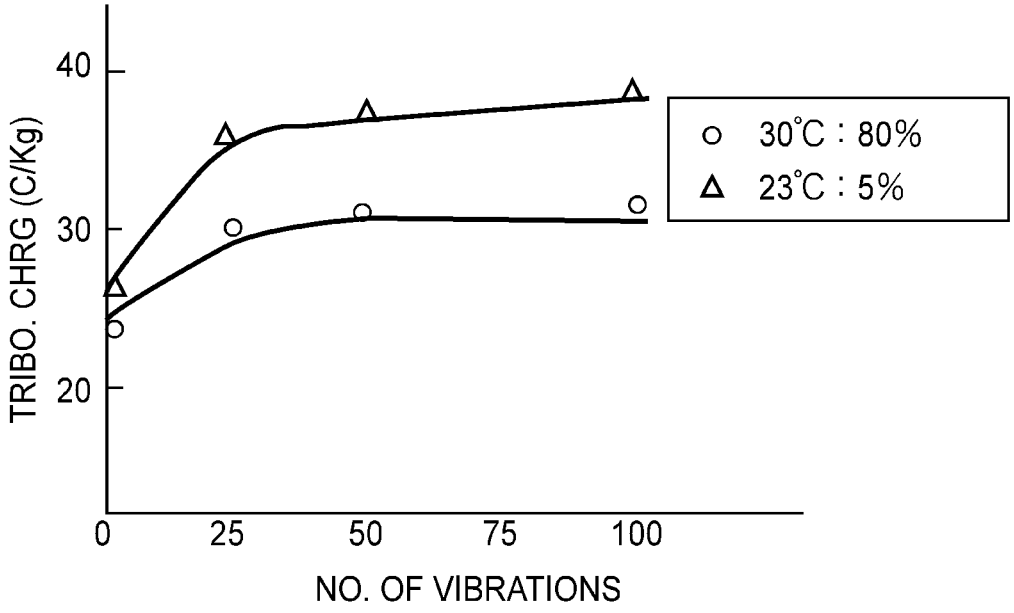
FIG. 4 is a graph which shows the relationship between the amount of the triboelectricity obtained by the developer (toner) during the startup period of the image forming apparatus, and the number of times the developer container was shook.

As will be evident from FIG. 4, of the two bodies of developer which were left unattended for a substantial length of time in the environments which were 23° C. and 30° C. in temperature, and 5% and 80% in RH, respectively, having therefore become acclimated to the environment, the former was better in terms of the triboelectricity startup than the latter, but was higher in triboelectricity saturation level, and therefore, was longer in the length of time it takes for the developer to become saturated with triboelectricity.

Figure 6:
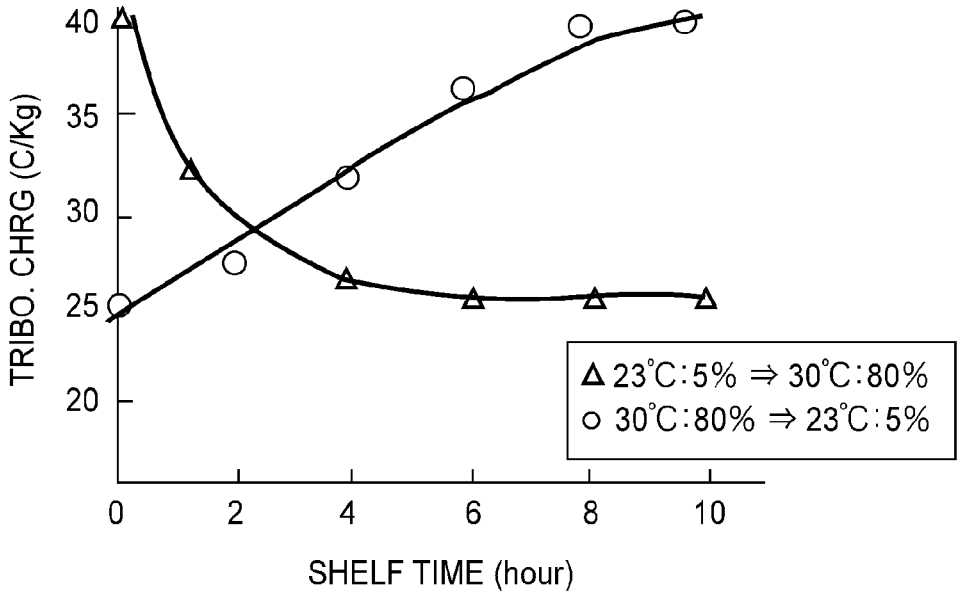
FIG. 6 is a graph which shows the relationship between the amount of toner charge and the length of time the developer was left unattended, and shows the speed with which the developer became acclimated to its ambience.

Next, one of the two bodies of developer was adjusted in moisture content (humidity) by being left unattended for a substantial length time in an environment which was 23° C. in temperature and 5% RH, and then, was left unattended for a substantial length of time in an environment which was 30° C. in temperature and 80% in humidity. The other body of developer was adjusted in moisture content by being left unattended for a substantial length time in an environment which was 23° C. in temperature and 5% RH, and then, was left unattended for a substantial length of time in an environment which was 30° C. in temperature and 80% in humidity. Then, the changes (in amount of moisture content) which occurred to the amount of the triboelectricity of the bodies of developer were plotted on a graph (FIG. 6), the vertical and horizontal axes of which stands for the amount of triboelectricity and the length of the elapsed time, respectively (Study 2). As is evident from FIG. 6, the developer did not become quickly acclimated to the environment in terms of the amount of the triboelectricity; the developer slowly changed in the amount of moisture content. More specifically, the length of time it took roughly eight hours for the developer kept in the high humidity environment to change in the amount of moisture content to the value equal to the amount of moisture content of the developer fully acclimated to the low humidity environment. That is, it took roughly twice the length of time it took for the developer fully acclimated to the low humidity environment to increase in moisture content to a value equal to the moisture content of the developer fully acclimated to the high humidity environment. That is, the speed at which the developer fully acclimated to the high humidity environment decreased in moisture content after it was placed in the low humidity environment was substantially slower than the speed at which the developer fully acclimated to the low humidity environment increased in moisture content after it was placed in the high humidity environment. This means that the two bodies of developer were different in the length of time it took for moisture to be adhered to the surface of a carrier particle, or the surface of a toner particle. That is, the length of time it takes for moisture to be adhered to a carrier particle or a toner particle of a given developer may be thought to be attributable to the properties of the resin used as the material for the carrier and/or toner.

Next, the properties of the developer t in the developing apparatus was studied in terms of the startup increase in the amount of triboelectricity. More concretely, the developer t was kept in an environment which was 30° C. in temperature and 80% RH for a long enough to become stable in moisture content, and then, was placed in the developer container 31 of the developing apparatus 3. Then, the development sleeve 32 and screws 37 and 38 were idled together while measuring the amount of the triboelectricity of the developer t in the developer container 31. The development sleeve 32 and screws 37 and 38 were 20 ϕ in diameter, and, 500 rpm in revolution. The amount of the developer t placed in the developer container 31 was 300 g (Studies 3). The results of the measurement were plotted (with circles) in a graph (FIG. 7) in which the results of the experiment in which only the screws 37 and 38 were idled (rotated) to study the amount of their contribution to the amount by which the developer was given the triboelectricity, and the results of the experiment in which only the development sleeve 32 was idled (rotated) to study the amount of its contribution to the amount by which the developer was given the triboelectricity, are plotted.

Figure 7:
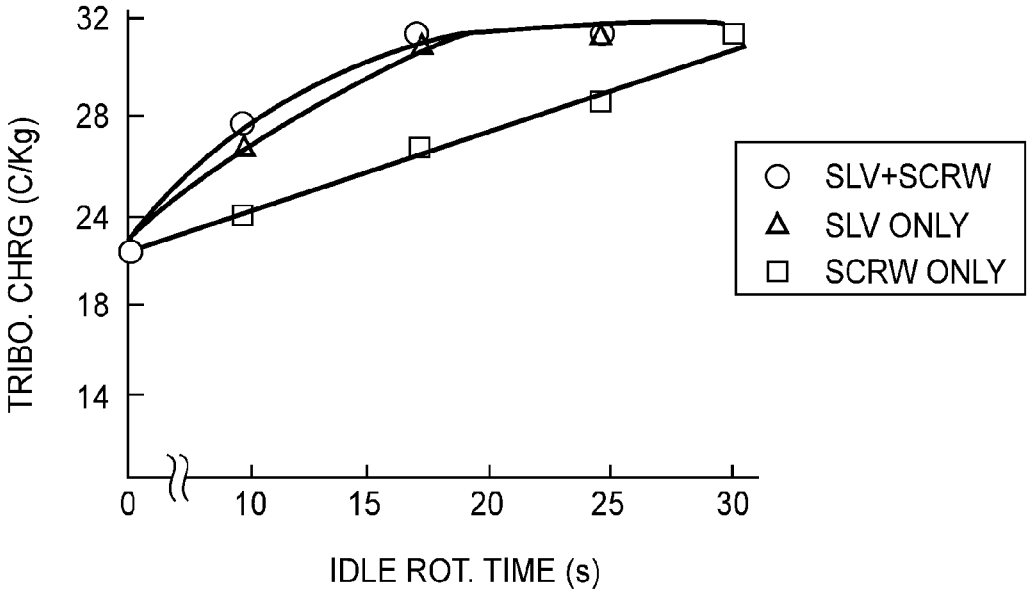
FIG. 7 is a graph which shows the relationship between the amount of toner charge and the length of time the developing apparatus was idled (developer was stirred).

As is evident from FIG. 7, the developer became saturated with the triboelectricity regardless of which of the three members was idled (rotated) to convey the developer while stirring it. However, the idling (rotation) of the development sleeve 32 was most effective to start up the developer in triboelectricity. This indicates that the rotation of the development sleeve 32 is one of the most influential factors upon the amount by which the developer is given triboelectricity.

Next, the reason why the rotation of the development sleeve 32 is one of the most influential factors upon the amount by which the developer is given triboelectricity is described with reference to FIG. 3. The excess amount of the developer, that is, the developer on the development sleeve 32, which was prevented by the regulating blade 34 from being conveyed beyond the regulating blade 34, made to remain on the immediate adjacencies of the upstream side of the regulating blade 34 in terms of the rotational direction of the development sleeve 32, by the magnetic force generated by the poles S2 and N2 of the magnetic 33. It is in this immediate upstream adjacencies of the regulating blade 34 that the excess amount of developer collects (developer reservoir G). As the development sleeve 32 is rotated, the developer reservoir G is continuously supplied with the developer t. In other words, there is always a developer flow in the developer reservoir G. This developer flow causes friction between the magnetic carrier and nonmagnetic toner in the developer t. This is why the rotation of the development sleeve 32 was one of the most influential factors upon the amount by which the developer was given triboelectricity.

Next, therefore, the relationship between the size of the developer reservoir G, that is, the amount of the developer t in the developer reservoir G, and the startup increase in the amount of the triboelectricity of the developer, was studied. More concretely, three magnets (33) which were 450, 650, and 850 gauss, respectively, in maximum magnetic flux density at the magnetic pole S2 were made, and were tested in experiments similar to the one in which the magnet 33 was used (Study 4). The results of these experiments are shown in Table 1.

TABLE 1

| Max M.F.G*1 (gauss) | Amount*2 (g) | Time*3 (sec) |
|---|---|---|
| 450 | 80 | 30 |
| 650 | 120 | 15 |
| 850 | 150 | 10 |

*1"Max M.F.G" is maximum magnetic flux density (gauss) at the magnetic pole S2.
*2"Amount" is the amount (g) of the developer which was in the developer reservoir G.
*3"Time" is the length (sec) of time it took for the developer in the developer container 31 to become saturated triboelectricity.

Table 1 shows the amount of the developer which was in the developer reservoir G when the developer in the developer container 31 became saturated with triboelectricity, and the length of time it took for the developer in the developer container 31 to become saturated with triboelectricity. As is evident from Table 1, the results of these experiments indicate that there is a strong relationship between the amount of the developer in the developer reservoir G, and the startup increase in the amount of the triboelectricity of the developer.

It became evident from the results of the studies described above, the condition of developer and the amount of the developer in the developer reservoir G on the upstream adjacencies of the regulating blade 34 are two of the largest of the various factors which affect the amount of the triboelectricity of the developer in the developer container 31. This finding suggested that what is necessary to accurately detect (predict) the change in the amount of the triboelectricity of the developer in the developer container 31 is to place the environment sensor 35 in the developer reservoir G, that is, the location (point A in developer container in FIG. 3) where the developer flow continuously occurs as the development sleeve 32 is rotated.

Thus, an experiment was carried out in which the environment sensor 35 was actually placed in the developer reservoir G in the developer container 31 as shown in FIG. 3 (Study 5), and in which the changes in the moisture content of the developer were measured while idling the developing apparatus 3 (under the same conditions as those described above) in an ambience in which the temperature and humidity were kept at 30° C. and 80%RH, respectively. Further, an experiment which was different from the above-mentioned one only in that the environment sensor 35 was placed at a point B (on bottom surface of development chamber R1), and an experiment which was different from the above-mentioned one only in that the environment sensor 35 was placed at a point C (space above body of developer, where sensor 35 does not come into contact with developer), were carried out for comparison.

Figure 8:
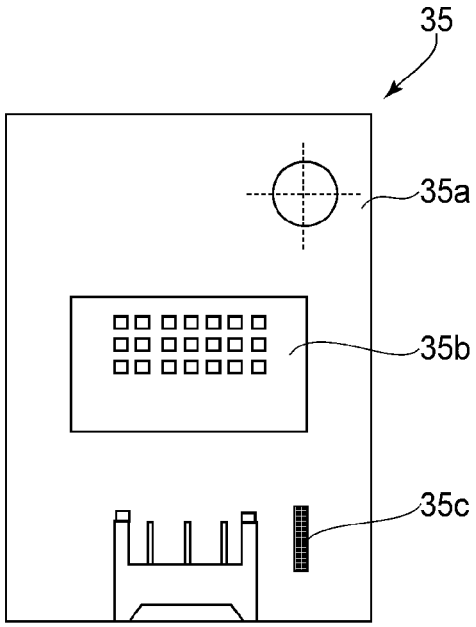
FIG. 8 is a schematic drawing of an example of environment sensor, and shows the general structure of the sensor.

Referring to FIG. 8, the environment sensor 35 is a sensor capable of measuring both temperature and humidity. It is made up of a hygrometer 35*b*, a thermistor 35*c*, and a base 35*a* (to which sensors 35*b* and 35*c* are attached). In the experiments in which the environment sensor 35 was placed in the body of developer, the environment sensor 35 was covered with a filter (moisture permeation preventing member) which is very easily permeable by gas (air), in order to protect the surface of the sensor 35. Also in these experiments, the changes which occurred to the amount of the triboelectricity of the developer in response to the changes in the ambience in which the developing apparatus 3 was operated were measured.

Figure 9:
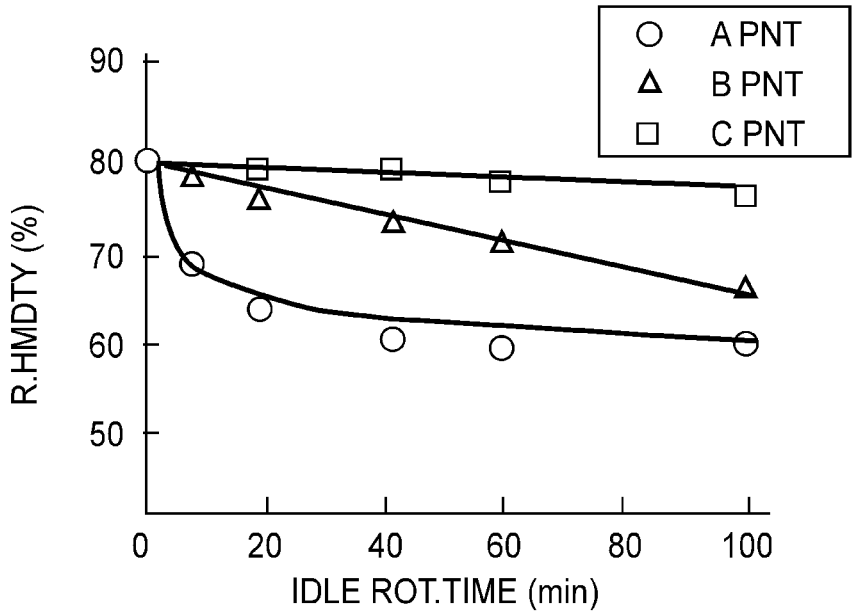
FIG. 9(A) is a graph which shows the relationship between the environment sensor position in the developing apparatus and the detected changes in the humidity.
FIG. 9(B) is a graph which shows the relationship between the amount of toner charge and the length of time developer was stirred (developing apparatus was idled).
Figure 9:
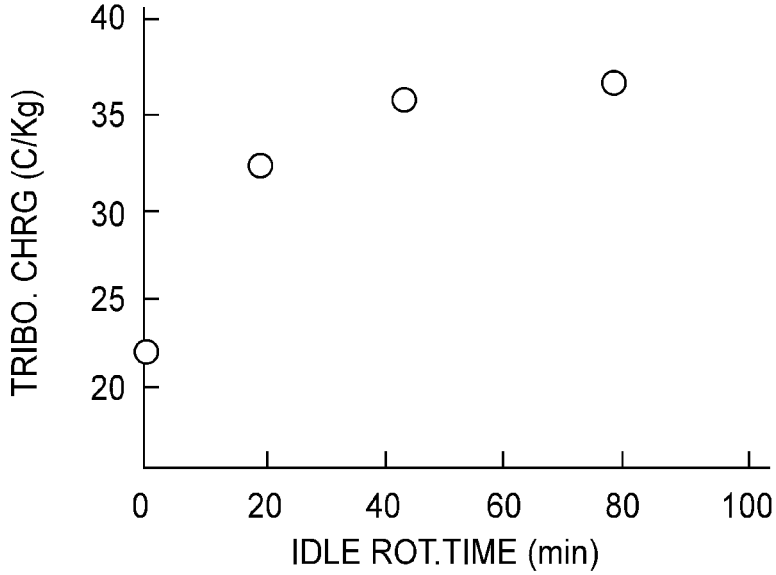

The results of these experiments are given in FIG. 9. It is evident from FIG. 9(A) that as the developing apparatus 3 was idled for a substantial length of time, the developer container 31 became nonuniform in internal temperature, which in turn made the developer container 31 nonuniform in internal relative humidity. In terms of the placement of the environment sensor 35, the experiment in which the environment sensor 35 was placed in the developer reservoir G (plotted with circles in FIG. 9) showed a strong correlation between the condition of the developer and the amount of the triboelectricity of the developer. This correlation is shown in FIG. 9(B). In comparison, in the experiment in which the environment sensor 35 was placed at point B (results were plotted in rectangles in FIG. 9(A)), the environment sensor 35 did not accurately show the changes in the internal relative humidity of the developer container 31. The reason for the results seems to come from the fact that point B is between the screw 37 and the bottom of the developer container 31, being therefore a dead spot in terms of developer flow (movement), and therefore, the body of developer in the adjacencies of the environment sensor 35 did not accurately reflect the changes in relative humidity which were occurring to the major portion of the body of developer in the developer container 31. Further, in the experiment in which the environment sensor 35 was at point C (results were plotted with squares in FIG. 9(A)), the environment sensor 35 was worst in terms of the detection of the changes in the moisture content of the developer. It is reasonable to think that these results came from the adiabatic effect of air. Therefore, it was possible based on the results of these experiments that the best location for the environment sensor 35 in the developer container 31 is in the developer reservoir G in the upstream adjacencies of the regulating blade 34.

Further, the reason why the inside of the developer container 31 became nonuniform in relative humidity was investigated. As the experiment carried out to find out the cause of this nonuniformity, an experiment was carried out in which thermography was used to observe the temperature distribution of the developing apparatus. It was confirmed by the experiment that with the increase in the length of time the developing apparatus 3 was idled, the adjacencies of the regulating blade 34 increased in temperature, which in turn caused the change in relative humidity. More concretely, the temperature of the adjacencies of the regulating blade 34, which was 30° C., increased by 4° C. Further, as the development sleeve 32 was increased in revolution to 700 rpm, the temperature increased by 4° C. Thus, it was concluded that as the developing apparatus 3 was idled, heat was generated by the developing apparatus driving motor, etc., and this heat was transmitted through the regulating blade 34 (which is a metallic member) to the body of developer which was on the upstream side of the regulating blade 34, causing thereby the developer in the developer reservoir G to increase in temperature. Thus, it became evident that the environment sensor 35 is desired to be placed in, or in the proximity, of the body of developer which is in the adjacencies of the development sleeve 32 (which also is heat source in developer container 31) and regulating blade 34.

In this embodiment, the environment sensor 35 was placed in the adjacencies of the peripheral surface of the development sleeve 32, between the regulating blade 34 and the point (point A in FIG. 3) at which the developer t remaining on the peripheral surface of the development sleeve 32 after the transfer of an electrostatic latent image separates from the development sleeve 32, in terms of the rotational direction of the development sleeve 32. More specifically, the developer reservoir G was selected as the location in which the environment sensor 35 is to be placed. That is, the environment sensor 35 was placed in the developer reservoir G in which the developer flow occurs as the development sleeve 32 is rotated, and which therefore is higher in the amount by which the developer t is given triboelectricity, more specifically, immediately upstream of the regulating blade 34 in the developer container 31. Therefore, the changes caused to the developer by the changes in the ambience of the developer can be accurately detected. Therefore, the amount of the triboelectricity of the toner, which affects the development of an electrostatic latent image, and the transfer of the resultant toner image, can be accurately estimated.

As long as the amount of the triboelectricity of the toner can be accurately estimated, an image forming apparatus can be properly controlled in its image formation settings, based on this information using the conventional control method. The image formation settings which can be controlled are the voltage to be applied to the development sleeve 32 to develop an electrostatic latent image on the photosensitive drum 1, and the pulse width of the beam of laser light for exposing the uniformly charged portion of the peripheral surface of the photosensitive drum 1 to form an electrostatic latent image, for example. There are also the amount by which developer is supplied to the developer container 31 by an unshown developer supplying apparatus, length of time developer is stirred while being conveyed through the first and second developer conveyance passages in the developer container 31, and development contrast (voltage). Further, there is the voltage to be applied between the photosensitive drum 1 to transfer a developer image (toner image) from the photosensitive drum 1 directly onto a sheet of recording medium, or to transfer a developer image (toner image) onto the intermediary transfer member (which will be described later referring to FIG. 9). Moreover, it may be only one or two or more (or all of) of the settings that are controlled. Thus, an image forming apparatus can be prevented from changing in the density level at which it outputs images, by feeding back the information regarding the above-described amount of the triboelectricity of the toner in the developer container to the control portion to adjust the image formation settings of the image forming apparatus in response to the information.

<Embodiment 2>

Figure 10:
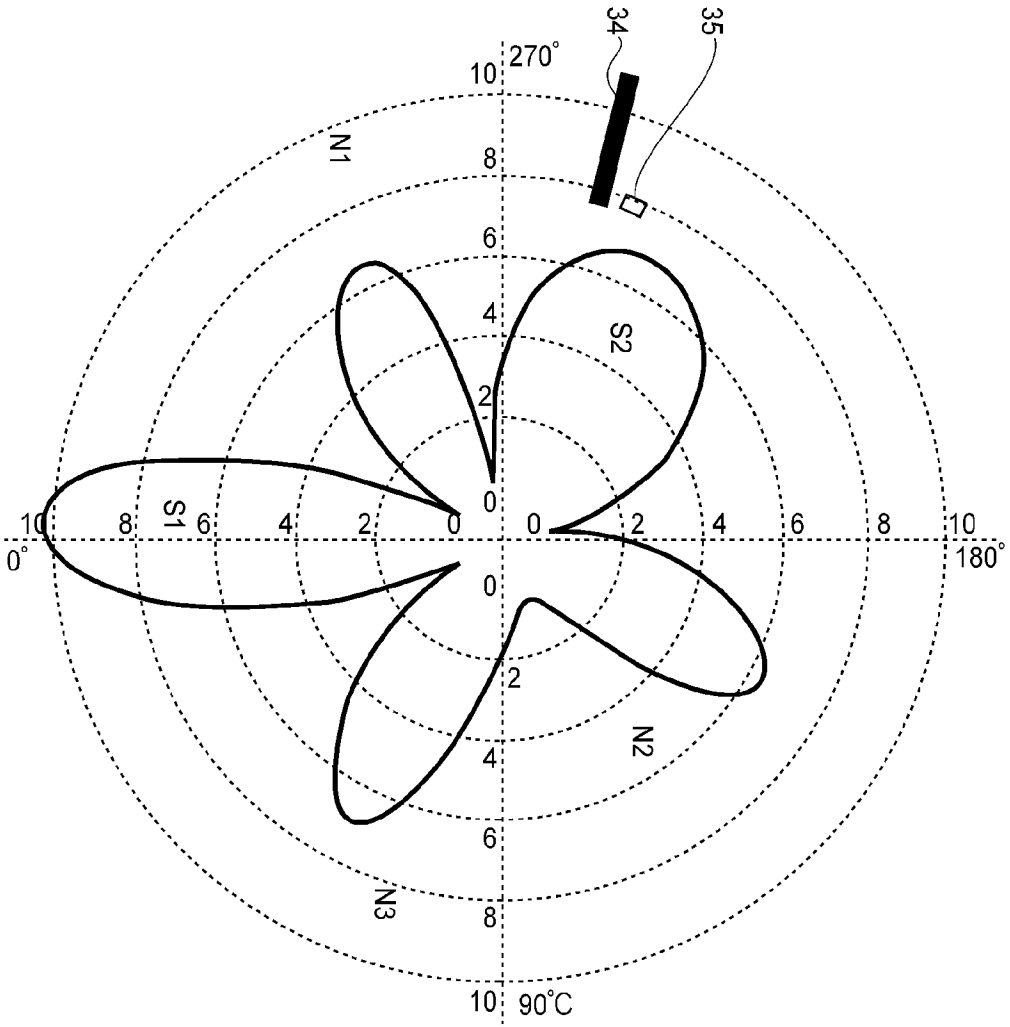
FIG. 10 is a graphical drawing which is for describing the second preferred embodiment of the present invention, and shows the magnetic flux density pattern of the magnet.

Next, referring to FIGS. 1, 3 and 10, the second preferred embodiment of the present invention is described. As mentioned in the description of the first embodiment of the present invention, it was found out that the location in which the environment sensor 35 is to be placed to accurately detect the changes which occurred to the developer due to the changes in the internal ambience of the developing apparatus 3, is desired to be in the developer reservoir G, which is in the adjacencies of the regulating blade 34. The developer reservoir G in the immediate adjacencies of the peripheral surface of the development sleeve 32 (which is one of decisive factors that affects the amount by which toner is given triboelectricity), and retains an ideal amount of developer. Further, the adjacencies of the regulating blade 34 is relatively sensitive to the thermal changes which occur in the adjacencies of the developer container 31. This is why the developer reservoir G, which is in the adjacencies of the regulating blade 34, is preferable as the location for the environment sensor 35. In this embodiment, the environment sensor 35 was better positioned than in the first embodiment, that is, it was placed in the preferable place in the developer reservoir G.

FIG. 10 shows the pattern of the force of the magnet 33 (maximum magnetic flux density) of the magnetic 33. The developer crests in the direction parallel to the line of the magnetic flux density. Therefore, the developer crests highest in the adjacencies of where the magnetic flux from the magnetic pole (S2) which is responsible for the formation of the developer reservoir G is highest in density. In other words, the amount of developer per unit area of the peripheral surface of the development sleeve 32 is largest in the developer reservoir G. Therefore, it is desired that the environment sensor 35 is placed in the adjacencies of where the developer crests highest (peaks). Further, the environment sensor 35 is desired to be placed on the regulating blade (which is heat conductor to developer) side of the peak.

Thus, in this embodiment, the environment sensor 35 was placed between the regulating blade 34 and the point which is highest in the density of the magnetic flux from the most upstream magnetic pole (S2), in terms of the rotational direction of the development sleeve 32, among the multiple magnetic poles, in the developer reservoir G. Incidentally, FIG. 10 shows only the positions of the regulating blade 34 and environment sensor 35 in terms of the rotational direction of the development sleeve 32. This embodiment is greater in the developer flow in the adjacencies of the environment sensor 35, being therefore more accurate in detecting the changes in the relative humidity in the body of developer, i.e., the changes in the amount of triboelectricity of the toner, than the first embodiment. The developing apparatus in this embodiment is the same in structure and function, except for the positioning of the environment sensor 35, as the developing apparatus in the first embodiment.

<Embodiment 3>

Next, referring to FIGS. 1, 3, 10 and 11, the third preferred embodiment is described. In the case of this embodiment, the speed at which the developer on the peripheral surface of the development sleeve 32 is conveyed in the adjacencies of the developer reservoir G was studied in detail. More concretely, from the magnetic flux density pattern of the magnet 33, attention was paid to the component of the magnetic force F (vector) from the magnet 33, which is parallel to the line tangential to the peripheral surface of the development sleeve 32 (peripheral surface of image bearing member) at a given point on the peripheral surface of the development sleeve 32.

That is, of the density B (Br, Bθ) (vector) of the magnetic flux generated by the magnet 33 at a given point on the peripheral surface of the development sleeve 32, Br stands for the component parallel to the normal line to the peripheral surface of the development sleeve 32, that is, the line perpendicular to the peripheral surface of the development sleeve 32, and Bθ stands for the directional component parallel to the line tangential to the peripheral surface of the development sleeve 32 at the given point. As attention was paid to the angle of the sum of the square of the absolute value of Br and the square of the absolute value of the Bθ, relative to the direction parallel to the line tangential to the peripheral surface of the development sleeve 32 at the given point on the peripheral surface of the development sleeve 32, this angle corresponds to the amount of force generated by the stationary magnetic 33 in the development sleeve 32 in the direction to convey the magnetic carrier by which the toner are carried.

That is, the amount (unit of measurement: Newton) of the component Fθ (Fθ1) of the magnetic force which works on each magnetic carrier particle in the direction parallel to the tangential line of the development sleeve 32 is expressed by the following mathematical equation, in which a minus sign corresponds to the rotational direction of the development sleeve 32:

The amount F of the magnetic force which works on each magnetic carrier particle can be simply expressed as follows:

$$F=-A\nabla\theta(m\cdot B).$$

From this equation, $$F\theta=-Ad/d\theta(|m|VB\cdot B=|m|VAd/d\theta(B^2)=|m|VAd/d\theta\{(Br)^2+B\theta)^2\}.$$

In the above equation, m stands for the amount of the magnetic carrier magnetization (vector, unit of |m| is A/m). |m| is a function of permeability. Since θ stands for the direction perpendicular to the peripheral surface of the development sleeve 32, the direction of the force is parallel to the rotational direction of the development sleeve 32. Further, V stands for the volume ($m^3$) of each magnetic carrier particle, and A is a constant.

As will be evident from the equations given above, the amount Fθ of the force which works on a given point on the peripheral surface of the development sleeve 32 in the direction parallel to the line tangential to the peripheral surface of the development sleeve 32 at the given point is proportional to the gradient (positivity corresponds to rotational direction of development sleeve 32) of the of the sum of the square of the absolute value of Br and the square of the absolute value of Bθ, relative to the direction parallel to the line tangential to the peripheral surface of the development sleeve 32 at a given point on the peripheral surface.

Figure 11:
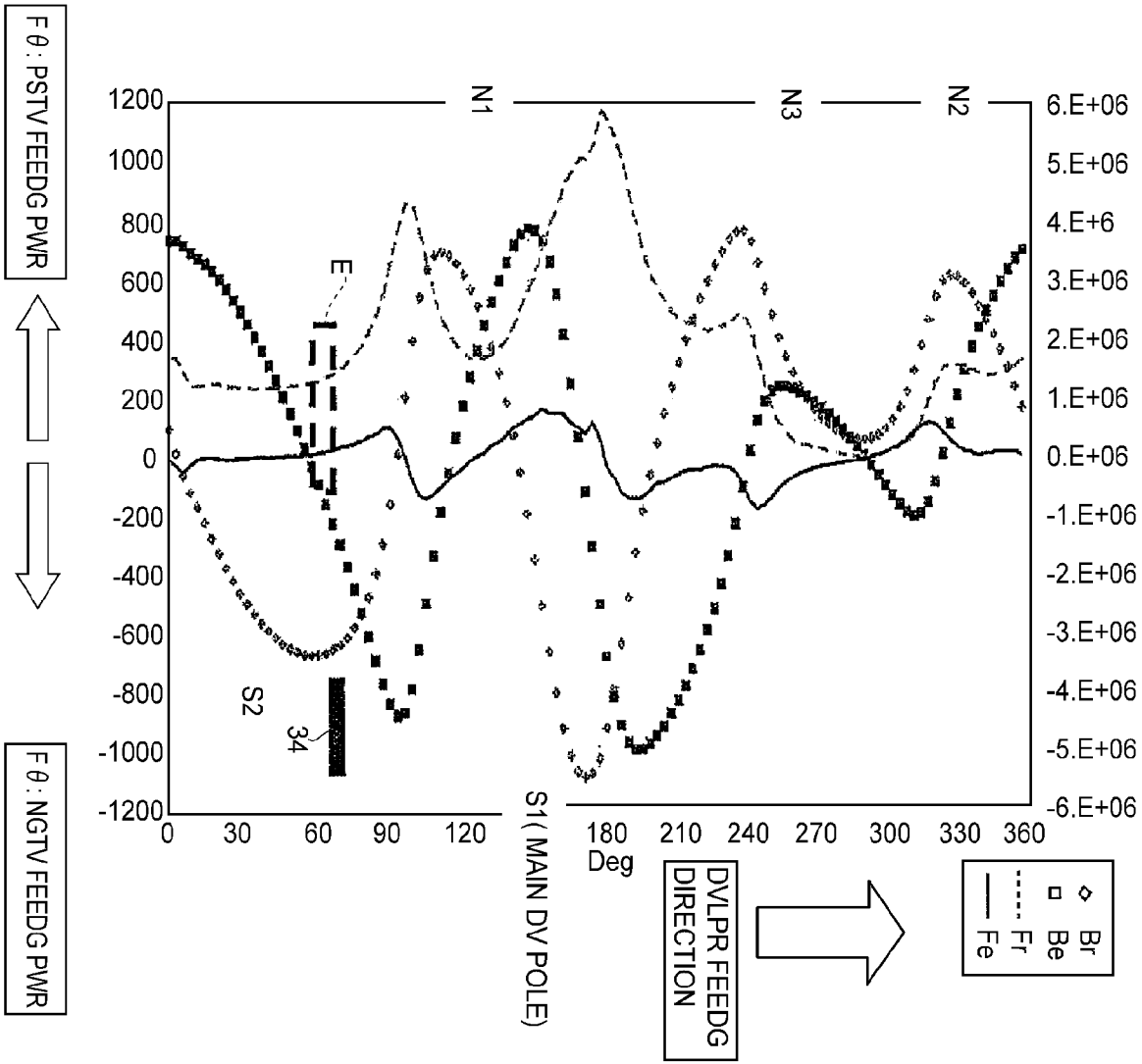
FIG. 11 is a graphical drawing which is for describing the third preferred embodiment of the present invention, and shows the magnetic force distributions which correspond to Br, Bθ, Fr, and Fθ of the magnet.

FIG. 11 is a graph which shows an example of the distribution of the magnetic force from the magnet 33, at (Br, Bθ) and (Fr, Fθ). It also shows the position of the regulation blade 34 (blade 34 is on 13° downstream side of magnetic pole S2 in terms of developer conveyance direction. Incidentally, developer conveyance direction is the same as rotational direction of development sleeve 32). On the side of the graph where the value of Fθ is positive, the magnetic force functions as a developer conveyance force, whereas on the side of the graph where the value of the magnetic force Fθ is negative, the magnetic force functions as a force (developer retention force) that works in the opposite direction to the developer conveyance direction. That is, the zone in which the value of Fθ is positive is greater in terms of the amount of force that works in the direction parallel to the direction in which the developer is conveyed by the development sleeve 32.

By the way, the location for the environment sensor 35 is desired to be as high as possible in the amount of force that works in the direction parallel to the developer conveyance direction, that is, as strong as possible in developer flow, as described above. It is also desired to be in the proximity of the regulating blade 34 which functions also as a heat source. In this embodiment, therefore, the environment sensor 35 was placed in an area E, that is, the area surrounded by a dotted line in FIG. 11. That is, it is at a point between the regulation blade 34 and the point in the developer reservoir, which is highest in the density of the magnetic flux from the magnetic pole S2, in terms of the rotational direction of the development sleeve 32. Further, it is in the area in which the directional component of the vector of the magnetic force, which is parallel to the line tangential to the peripheral surface of the development sleeve 32 at a given point on the peripheral surface of the development sleeve 32, coincides with the developer conveyance direction. Therefore, as the development sleeve 32 is rotated, the developer flow occurs in the immediate adjacencies of the environment sensor 35. Therefore, the changes in the developer properties, which are caused by the developer ambience, can be accurately detected. Except for the placement of the environment sensor 35, the developing apparatus in this embodiment is the same in structure and function as those in the first and second embodiment described above.

<Embodiment 4>

Figure 12:
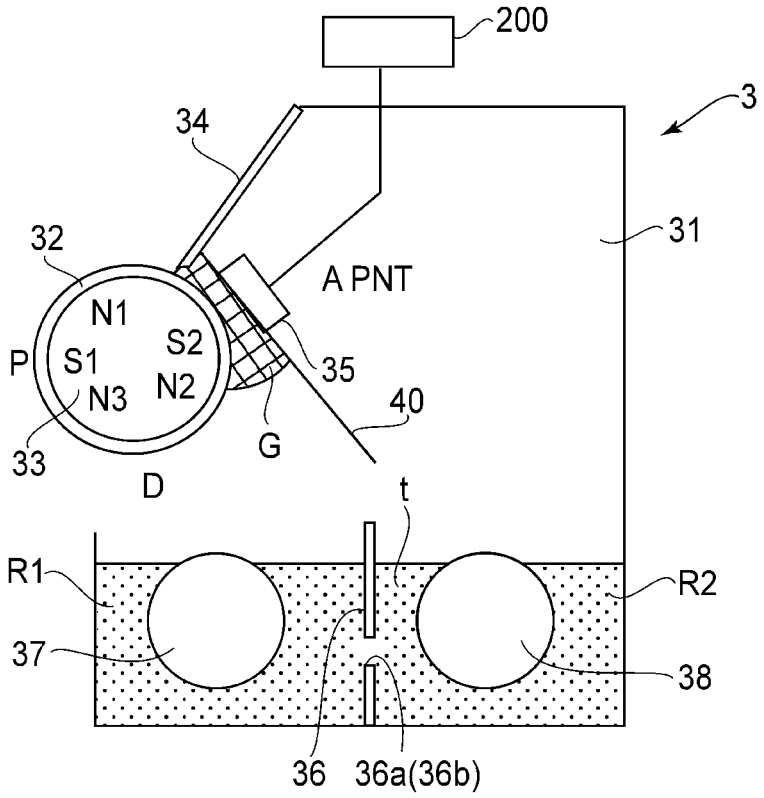
FIG. 12 is a schematic sectional view of the developing apparatus in the fourth preferred embodiment of the present invention, and shows the general structure of the apparatus.

Next, referring to FIG. 12, the fourth preferred embodiment of the present invention will be described. First, paying attention to the amount of the magnetic force F in the adjacencies of the developer reservoir G, the farther from the peripheral surface of the development sleeve 32, the less the magnetic flux density B, and therefore, the smaller the magnetic force F, as is evident from the description of the third embodiment given above. Therefore, the farther from the peripheral surface of the development sleeve 32, the smaller the force that works in the direction to convey the developer. Therefore, the top portion and bottom portion (portion next to peripheral surface of development sleeve 32) of the cresting portion of the developer layer on the peripheral surface of the development sleeve 32 are different in the conveyance speed. That is, the developer flow is greater in the adjacencies of the peripheral surface of the development sleeve 32. Therefore, it is reasonable to predict that even in the developer reservoir G, the adjacencies of the peripheral surface of the development sleeve 32 is greater than the area away from the peripheral surface of the development sleeve 32, in the amount by which the amount by which the toner is given triboelectricity is affected by the changes in the internal ambience of the developing apparatus 3.

Therefore, the developer temperature distribution in the developer reservoir G was obtained by inserting a thermocouple into the developer reservoir in the direction perpendicular to the peripheral surface of the development sleeve 32. As a result, it was discovered that the developer in the adjacencies of the peripheral surface of the development sleeve 32 in the developer reservoir G was slightly higher in temperature, that is, roughly 1° C. higher, than the developer farther away from the peripheral surface. The reason for this phenomenon was thought to be that the development sleeve 32 also functions as a heat source. Thus, it was thought that in order to accurately measure the developer temperature, the environment sensor 35 has to be placed in the immediate adjacencies of the peripheral surface of the development sleeve 32.

In this embodiment, therefore, the developer reservoir G of the developing apparatus 3 was provided with a developer amount regulation blade 40, which is a member for controlling the amount by which the developer is allowed to remain in the developer reservoir G, more specifically, a member for controlling the body of developer on the peripheral surface of the development sleeve 32 in the dimension (height), in terms of the direction perpendicular to the peripheral surface of the development sleeve 32, by which the developer layer crests in the developer reservoir G. The developer amount regulation blade 40 was formed of a nonmagnetic substance such as synthetic resin, and was positioned so that a preset amount of gap was provided between the blade 40 and the peripheral surface of the development sleeve 32, in order to control the height in which the developer is allowed to collect in the developer reservoir G. In terms of the rotational direction of the development sleeve 32, the location for the environment sensor 35 may be any of those in the first to third embodiments described above. Further, the distance of the environment sensor 35 from the development sleeve 32 should be less than that in any of the first to third embodiment described above.

Next, the experiment carried out to test the developing apparatus 3 structured as described above is described. The developer amount regulation blade 40 was positioned so that the smallest distance between the blade 40 and development sleeve 32 became 2 mm. Thus, the height of the body of developer in the developer reservoir G remained to be no more than 2 mm, whereas in the case where the developer amount regulation blade 40 was not provided, the height of the body of developer in the developer reservoir G was as high as 1 cm. Thus, it was possible to place the environment sensor 35 closer to the peripheral surface of the development sleeve 32 compared to a developing apparatus structured as that in the first embodiment. Therefore, it was possible to detect the temperature and humidity of the developer in the area closer to the peripheral surface of the development sleeve 32 than the area in which they are detected in the developing apparatuses in the preceding embodiments. Therefore, the temperature and humidity detected by the environment sensor 35 more accurately reflected the amount of the triboelectricity of the developer (toner).

The results of the experiment carried out to test the developing apparatus structured as described above are given in Table 2, and were subjected to the same studies as those to which the developing apparatuses in the preceding embodiments were subjected (portions related to Table 1).

TABLE 2

| Max M.F.G*1 (gauss) | Amount*2 (g) | Time*3 (sec) |
|---|---|---|
| 450 | 120 | 15 |
| 650 | 150 | 10 |
| 850 | 160 | 8 |

*1"Max M.F.G" is maximum magnetic flux density (gauss) at the magnetic pole S2.
*2"Amount" is the amount (g) of the developer which was in the developer reservoir G.
*3"Time" is the length (sec) of time it took for the developer in the developer container 31 to become saturated triboelectricity.

As will evident from Table 2, the provision of the developer amount regulation blade 40 improved the efficiency with which the developer was filled in the developer reservoir G. Therefore, the length of time it took for the developer (toner) to become saturated with triboelectricity was shorter even in a case where the developing apparatus was less in the magnetic flux density. Incidentally, when an image forming apparatus whose developing apparatus employed a magnet, whose magnetic pole S2 was 850 gauss in strength, as the magnet 35, was used for image formation (outputting images), the outputted images were extremely low in quality (more concretely, they were extremely grainy). The reason for these results may be thought to be as follows: First, the case in which the strength of the magnetic pole S2 was not different in the ratio by which the developer reservoir was filled with the developer, from the case in which the strength of the magnetic pole S2 was 650 gauss. Thus, it is reasonable to think that in either case, the developer reservoir G was virtually full with the developer. Even though the developer reservoir G was virtually filled up with the developer, the developer was continuously conveyed (pushed) into the developer reservoir G. In other words, a substantial amount of pressure was continuously applied to the developer in the developer reservoir G. Consequently, the magnetic carrier and nonmagnetic toner were pressed against each other, whereby the microscopic particles of titanium oxide and/or the like, as external additive, added to the developer to make it easier for the nonmagnetic toner particle to flow, were pressed into nonmagnetic toner particles, causing thereby the image forming apparatus to output images of low quality. Thus, the location for the developer amount regulation blade 40 was desired to be determined in consideration of the following standpoint. That is, the location for the developer amount regulation blade 40 was determined by taking into consideration the maximum magnetic flux density of the magnetic pole S2, that is, the magnetic pole for forming the developer reservoir G, the half value width, the gap between the developer amount regulation blade 40 and development sleeve 32, from the standpoint of the improvement of the developing apparatus 3 in terms of the startup increase in the triboelectricity of developer (toner) and prevention of the outputting of low quality images by the image forming apparatus. Except for the positioning of the developer amount regulation blade 40 in the developer container 31, the developing apparatus in this embodiment was the same in structure and function as those in the first to third embodiments described above.

<Embodiment 5>

Figure 14:
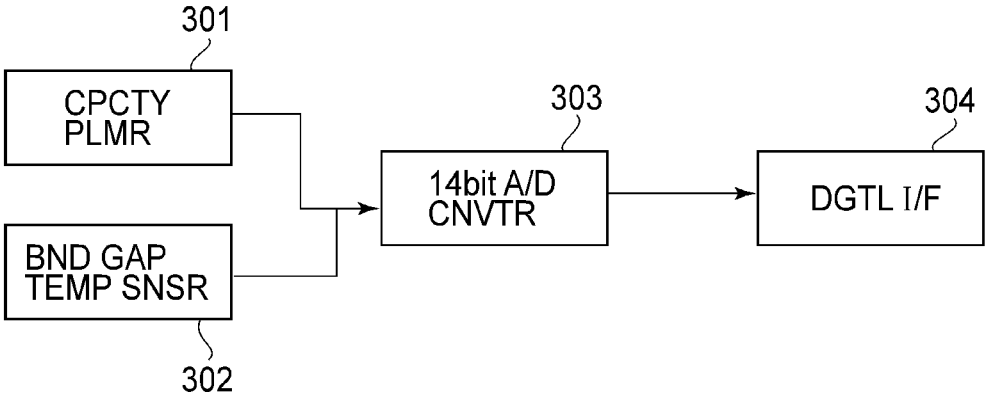
FIG. 14 is a block diagram of the environment sensor in the fifth embodiment of the present invention, and shows the general structure of the sensor.

Next, referring to FIGS. 1, 2 and 13-16, the fifth preferred embodiment of the present invention is described. In a case where the environment sensor 35 is placed in the developer reservoir G (which is on upstream side of regulating blade 34) as it was in each of the preceding embodiments, it is possible that noises will be generated in the output of the environment sensor 35 by the effects of the alternating electric field generated between the development sleeve 32 and photosensitive drum 1 to develop an electrostatic latent image on the photosensitive drum 1, although whether or not the noises are generated partly depends on the characteristics of the sensor 35. Further, the noises are more likely to be generated in a case where the environment sensor 35 is installed as shown in FIG. 14. Obviously, if the noises are generated in the output, it is impossible to accurately determine the temperature and humidity of the developer. In this embodiment, therefore, the environment sensor 35 was placed at the opening 36*a* of the partition wall 36 so that it always remains in contact with the developer. That is, of the openings 36*a* and 36*b* of the partition wall 36 which are at the upstream and downstream ends, respectively, in terms of the developer conveyance direction in the first developer conveyance passage, it is at the opening 36*a*, that is, the upstream opening of the partition wall 36, that the environment sensor 35 was placed.

Figure 13:
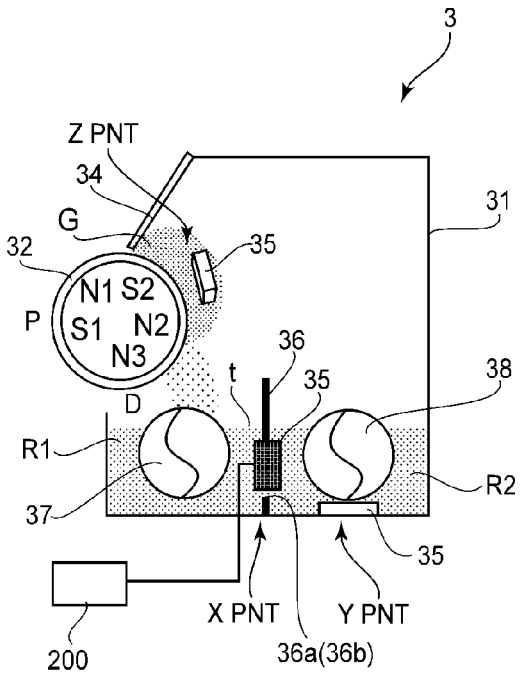
FIG. 13(A) is a schematic sectional view of the developing apparatus in the fifth preferred embodiment of the present invention, at a plane perpendicular to the rotational axis of the photosensitive drum, and shows the general structure of the apparatus.
FIG. 13(B) is a partially broken plan view of the developing apparatus in the fifth embodiment, as seen from the top side of the apparatus in FIG. 13(A).
Figure 13:
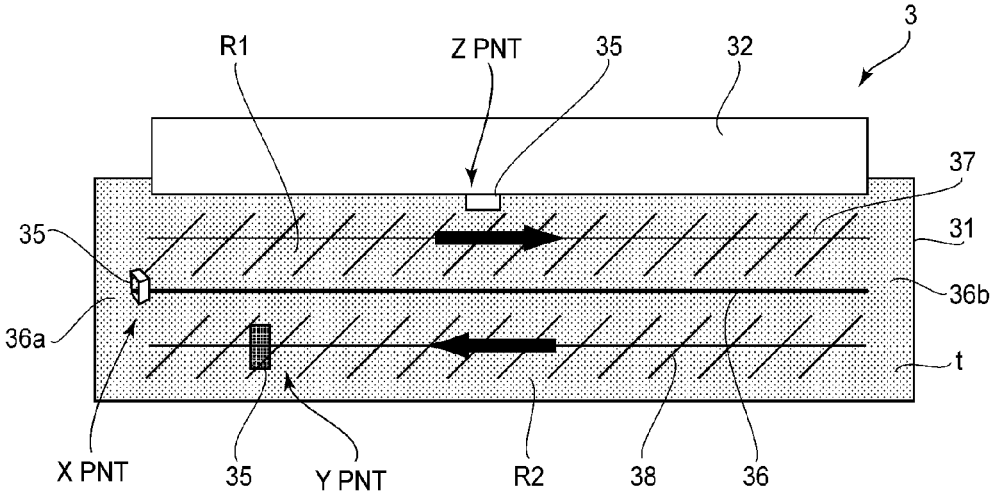

Next, the reason why the environment sensor 35 was placed as described above is described. One of the primary factors that affect the amount by which the toner is given triboelectricity is the condition of developer (in terms of temperature and humidity) as stated in the description of each of the preceding embodiments. Therefore, three developing apparatuses which were different in the placement of the environment sensor 35 in the developer, as shown in FIG. 13, were studied (tested). That is, for the first developing apparatus, the environment sensor 35 was placed in the upstream opening 36*a* of the partition wall 36, at a point which remains in the development flow (point X); for the second developing apparatus, next to the bottom of the screw 38 (point Y); and for the third developing apparatus, it was placed in the developer reservoir G (which is on upstream side of regulating blade 34) (point Z). Then, the changes in the developer humidity were measured.

More concretely, the developer chamber R1 and stirring chamber R2 of each of the three developing apparatuses 3 having the environment sensor 35 at points X, Y and Z, respectively, were filled with the developer left unattended for a substantial length of time in an ambience which was 23° C. in temperature and 5% in relative humidity, and the developer left unattended for a substantial length of time in an ambience which was 30° C. in temperature and 80% in relative humidity, respectively. Then, the chronological changes in the output of each environment sensor 35 was recorded while driving the developing apparatus 3. Incidentally, the environment sensing surface of the sensor 35 corresponds to the black surface of the sensor which is three dimensionally drawing in FIG. 13. That is, at point X, the sensing surface faces opposite to the partition wall 36, and at point Y, it faces upward in the drawing. Further, at point Z, it faces toward the development sleeve 32. Further, in order to allow the screw 37 for the first developer conveyance passage for supplying the development sleeve 32 with the developer 5, to function properly, the openings 36*a* and 36*b* are on the outward sides of the lengthwise ends of the development sleeve 32 in terms of the lengthwise direction of the development sleeve 32. That is, in terms of the lengthwise direction of the development sleeve 32, the openings 36*a* and 36*b* are outside the image formation range. In other words, point X is outside the image formation range.

The followings were found as the results of the above-described experiments. That is, in the case where the environment sensor 35 was placed in the developer reservoir G (which is on immediate upstream side of regulating blade 34) (point Z), the development bias applied to the development sleeve 32 disturbed the output of the sensor 35. That is, since the output of the sensor 35 was digital, it was a sequence of meaningless numbers. In other words, the humidity of the developer was not accurately detected. As for the results of the cases in which the environment sensor 35 was placed at points X and Y, respectively, the changes in the developer humidity are given in FIG. 15.

Figure 15:
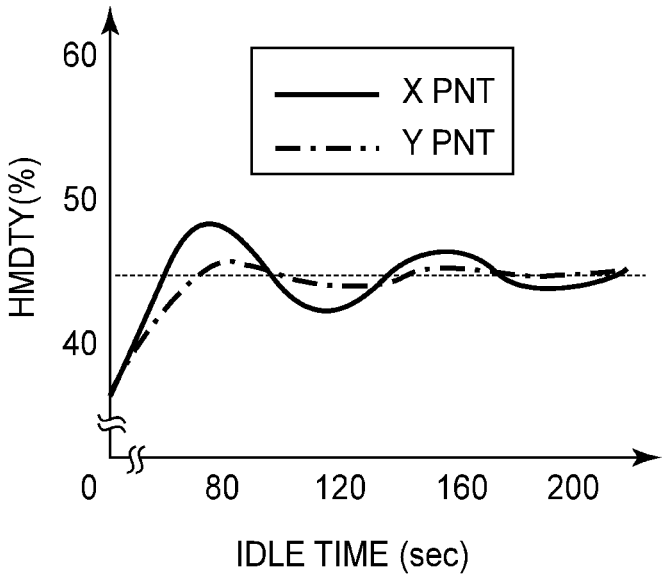
FIG. 15 is a graph which shows the difference between the relationship between the detected amount of humidity and the length of time the developing apparatus was idled when the environment sensor was at point X, and that when the environment sensor was at point Y.

It was reasonable to assume that in the experiments described above, the two bodies of developer, which were different in the ambience in which they were left unattended, become gradually acclimated to the ambience while being alternately conveyed through the adjacencies of the sensor 35. Thus, it was reasonable to assume that the greater the fluctuation of the detected developer humidity, which occurred with the same frequency with which the adjacencies of the sensor 35 was switched between the two bodies of developer, the more accurate the detected developer humidity. Referring to FIG. 15, the case in which the sensor 35 was at point X was roughly three times greater in the frequency of the fluctuation in the amount of the detected developer humidity than the case in which the sensor 35 was at point Y. Thus, it may be said that the placement of the environment sensor 35 at point X makes the environment sensor 35 roughly three times more sensitive to the changes in developer condition than the placement of the environment sensor 35 at point Y.

The reason for the above-described results may be thought to be that the body of developer t, which came into contact with the sensor 35 which was at point Y did not come into contact with the screw 38, creating therefore a stationary or slow moving layer of developer in the adjacencies of the sensor 35, which prevented the sensor 35 from detecting the changes in the developer humidity as they occurred. In comparison, it was thought that the body of developer, which came into contact with the sensor 35 placed at point X, were made to continuously flow by the pressure resulting from the continuous flow of the developer through the opening 36*b*, and therefore, the sensor 35 was enable to detect the changes in the developer humidity as they occurred.

It is evident from the above-described studies that the proper location for the environment sensor 35 is where the developer remains fluid without being in contact with the developer conveying members such as the screws 36*a* and 36*b*. Such a location that can satisfy the above-described requirements is limited to where the developer is made to continuously flow by the pressure provided by the developer itself, or by the remotely provided force such as the magnetic force provided by the magnet 33. As such a location, there is nothing, except for point X (or opening 36*b* which is on downstream side of point X), in the system such as the system in this embodiment.

On the other hand, the results of the experiment carried out to study the effect, upon the sensor 35, of the development bias applied to the development sleeve 32 revealed the following: In the case where 1.5 kV of alternating voltage was applied to the development sleeve 32 to create an alternating electric field, noises occurred when the sensor 35 was placed no more than 20 mm from the peripheral surface of the development sleeve 32. Further, it was found that in the case where the environment sensor 35 was placed on the outward side of one of the lengthwise ends of the development sleeve 32, that is, outside the image formation range, in terms of the lengthwise direction of the development sleeve 32, in the developing apparatus 3, the gap between the environment sensor 35 and the peripheral surface of the development sleeve 32, in which noises were generated, was smaller than the above-mentioned value. The cause of the occurrence of these noises is that generally speaking, a CMOS device cannot normally transmit digital signals through an electric field which is roughly $10^6$ V/m in strength. The location which is available for the environment sensor 35 and is no more than 20 mm from the peripheral surface of the development sleeve 32 is only point Z. Since point X is outside the image formation range, the environment sensor 35 located at point X is not affected by the development bias. Incidentally, from the standpoint of protecting the insulation layer of the input gate, point X is desirable as the location for the CMOS device. However, it may be said that even for other elements such as a TTL made of bipolar transistors, point X is superior from the standpoint of noise prevention.

In the case of the above-described experiment, the sensor 35 was placed in the opening 36*a*. However, in addition to the opening 36*a*, there is the opening 36*b*, that is, the opening which the lengthwise end portion of the first developer conveyance passage in terms of the developer conveyance direction, as the location for the environment sensor 35. From the standpoint of the requirement that the location for the environment sensor 35 has to be where the developer continuously flows as the developing apparatus 3 is operated, either of the two openings 36*a* and 36*b* is satisfactory. However, the body of developer t, which is at the upstream opening 36*a*, is longer in the length of time it takes for it to be supplied to the photosensitive drum 1 by the development sleeve 32 than the body of developer t, which is at the downstream opening 36b, being therefore closer in condition (temperature and humidity) to the condition in which it will be when it is actually supplied to the photosensitive drum 1. The closer to the condition in which it will be supplied to the photosensitive drum 1, the detected condition of the developer, the more properly the image formation settings can be controlled. Thus, in this embodiment, the opening 36*a* was selected as the location for the sensor 35.

Based on the above-described studies, in this embodiment, the environment sensor 35 was placed in the location through which the developer t flows after being conveyed through the opening 36*a* of the partition wall 36, and also, which is on the outward side (outside image formation area) of the corresponding lengthwise end of the development sleeve 32 in terms of the lengthwise direction of the development sleeve 32. Therefore, it was possible to accurately predict the amount of the triboelectricity of the toner, which affects the development of an electrostatic latent image and the transfer of the developed image. Further, in this embodiment, the lookup table referenced to convert the RGB image data inputted from a scanner (for scanning original), a computer, or the like (information processing apparatus) into CMY density data was adjusted based on the output from the humidity sensor.

Figure 16:
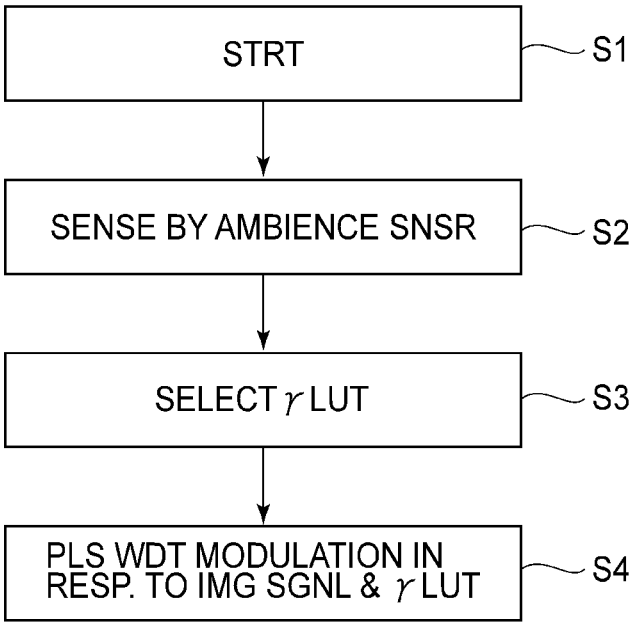
FIG. 16 is a flowchart of the sequence for controlling (determining) the image formation settings for the image forming apparatus, based on the developer condition.

Next, referring to FIG. 16 (flowchart), the flow of this lookup table adjusting process is described in detail. In this embodiment, five different γ lookup tables were in a ROM 208, for each of four colors, that is, yellow (Y), magenta (M), cyan (C), and black (K). Each table is used after being developed in a RAM 209 in response to the instruction from the CPU 207. The γ lookup table is a table which shows the relationship between the inputted image formation signal and the proper (correct) pulse width for the laser beams emitted for exposure, which is necessary to make the image forming apparatus output images which have desired density and tone. That is, it is a table for determining a proper output level (one of 256 levels) based on the level (one of 256 levels) of the inputted image formation signal. Generally speaking, the higher the relative humidity, the less the amount of the triboelectricity of developer (toner). Therefore, the higher the relative humidity, the higher the level at which images will be in density as they are outputted. In this embodiment, therefore, the images outputted in a low humidity environment, images outputted in normal humidity environment, and images outputted in a high humidity environment, were compared in density in advance. More specifically, the low humidity environment was 23° C. in temperature and 5% in RH, and the normal humidity environment was 23° C. in temperature and 50% in RH. Further, the high humidity environment was 30° C. in temperature and 80% in humidity.

More concretely, in order to minimize the image forming apparatus (developing apparatus) in the difference in density among the images different in the environment in which they would be outputted, three different γ lookup tables were prepared for the low, medium, and high humidity environments, one for one, so that the beam of laser light will be increased in pulse width in a low humidity environment, whereas it is reduced in pulse width in a high humidity environment. Further, two more γ lookup table were prepared for the adjustment of the three tables. Thus, a total of five different γ lookup tables were created and stored in the ROM 208. As the developing apparatus 3 begins to be driven (Step 1), the developer humidity was determined based on the output of the environment sensor 35 located at point X (Step 2). Then, the CPU 207 develops in the RAM 209, the γ lookup table which matches the developer condition (temperature and humidity) detected by the sensor 35 (Step 3). Thereafter, the beam of laser light is projected while being modulated in pulse width by the pulse width modulating portion 205, based on the developed γ lookup table in the RAM 209 (Step 4), so that the image forming apparatus will output images, the density of which is at a preset desired level. Incidentally, the process described above can be performed by the image forming apparatus in any of the preceding embodiments.

The above-described sequence was carried out with the sensor 35 placed at point X, and then, at point Y. More concretely, in the case where the adjustment was made based on the output from the sensor 35 located at point Y when halftone images were outputted in a low humidity environment, the density fluctuation was roughly 0.08. However, as the sensor location was switched to point X, the density fluctuation reduced to roughly 0.03. Incidentally, in this embodiment, multiple lookup tables were prepared for multiple states of environment (developer conditions), one for one, and one of the table was selected as an appropriate one from among the multiple lookup tables. However, in order to make it possible to use a ROM which is smaller in capacity, the number of γ lookup tables may be reduced to one for each state of environment (developer condition). In such a case, the γ lookup table is to be adjusted by multiplying it with a preset ratio, or adding or subtracting a preset amount. The above-described sequence is also compatible with the first to fourth embodiments. The image forming apparatus (developing apparatus) in this embodiment is the same in structure and function as the one in the first embodiment described above.

<Embodiment 6>

Figure 17:
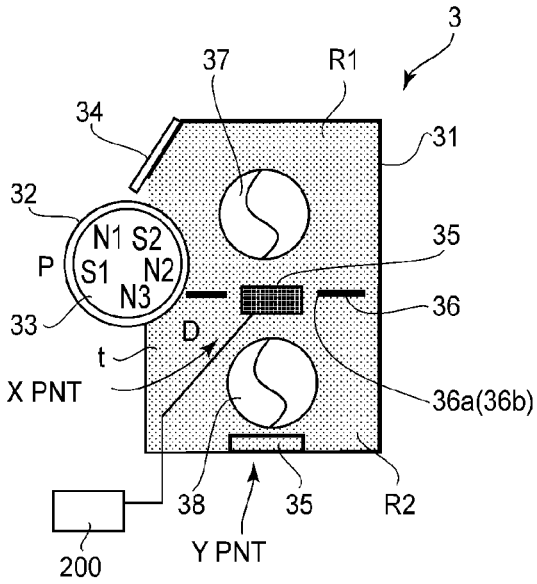
FIG. 17, which is similar to FIG. 13, is a schematic sectional view of the developing apparatus in the sixth preferred embodiment of the present invention, and shows the general structure of the apparatus.
Figure 17:
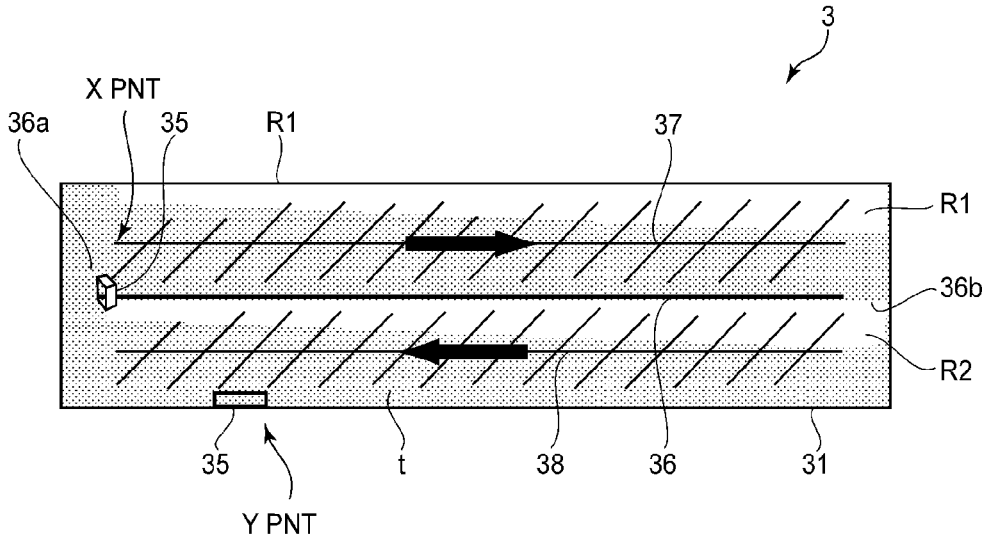

Next, referring to FIGS. 1, 2 and 17, the sixth preferred embodiment of the present invention is described. In the fifth embodiment described above, the developing apparatus was structured so that when the image forming apparatus is on a level surface, the development chamber R1 and stirring chamber R2 are level with each other. In comparison, in this embodiment, the present invention was applied to a developing apparatus of the so-called vertical stir type, that is, a developing apparatus in which its development chamber R1 was on its stirring chamber R2. Further, the environment sensor 35 was in the upstream opening 36*a* of the partition wall 36 in terms of the developer conveyance direction in the first developer passage.

Since it is necessary for the environment sensor 35 to remain always surrounded by a substantial amount of developer, the environment sensor 35 for this developing apparatus of the vertical stir type was placed in the upstream opening 36*a* (through which developer is lifted), instead of the upstream opening 36*b* which is smaller in the amount of developer. The upstream opening 36*a* is higher in the powder (developer) pressure, because the developer is lifted against gravity. Therefore, it is higher in developer density. Thus, in this embodiment, more developer comes into contact with the environment sensor 35 than in the fifth embodiment, in which the developing apparatus is of the vertical stir type. Therefore, the condition of the developer in the developer container, which is detected the environment sensor 35, is closer to the actual condition of the developer. Therefore, the developing apparatus can be highly precisely controlled in terms of image density.

Also in this embodiment, it is not by selecting an appropriate γ lookup table according to the detected condition of the developer that the developing apparatus is controlled. Instead, the developing apparatus is controlled by controlling Vcont, that is, one of the factors that affect development contrast. That is, the developing apparatus is controlled in the absolute value of the difference between the DC component Vdec (V) of the development bias, and the potential level V1 (V) of the exposed point of the peripheral surface of the photosensitive drum 1, to prevent the developing apparatus from fluctuating in image density because of the changes in the amount of the triboelectricity of toner, which is affected by the changes in the condition of developer. More concretely, the value of Vcont was calculated based on the developer humidity detected by the environment sensor 35, with reference to a preset Vcont lookup table. Then, the value for the high voltage bias to be applied to the primary charging device 1, and the value for the high voltage bias to be applied to the development sleeve 32, were set for image formation. Even more concretely, the relative humidity range was separated into five sub-ranges. Then, five Vcont lookup tables were created for five sub-ranges, one for one, and were stored in ROM 208. The Vcont lookup tables were created so that the higher the humidity, the lower the Vcont, whereas the lower the humidity, the higher the Vcont. That is, they were created based on the results of experiments in which images were outputted in each of the above-described sub-ranges of the humidity. Incidentally, the operational sequence described above is also compatible with the first to fifth embodiments.

An image forming apparatus in which the environment sensor 35 was at point X, and an image forming apparatus in which the environment sensor 35 was at point Y, were used to output images in a low humidity environment while carrying out the above-described operational sequence. In the case of the latter, the fluctuation in image density was roughly 0.08, whereas in the case of the former, it was roughly 0.03, being substantially less than that in the case of the latter. The image forming apparatus (developing apparatus) in this embodiment is the same in structure and function as that in the fifth embodiment.

By the way, the present invention which relates to a method for controlling an image forming apparatus and its developing apparatus(es) in image density by estimating the amount of the triboelectricity of the developer (toner) in the developer container by detecting the condition of the developer in terms of temperature and humidity can be embodied in the following manner, in addition to this embodiment and the fifth embodiment. That is, an image forming apparatus and its developing apparatus(es) may be structured so that in an environment in which the amount by which toner is going to be given triboelectricity is large, the amount by which toner is transferred onto the photosensitive drum 1 is increased by increasing, in peak-to-peak voltage, the AC component of the development bias; the amount by which developer is supplied to the developer container is increased to reduce the amount of contact between the carrier and toner to reduce the amount by which toner is going to be given triboelectricity; the length of time the developer is Stirred is reduced to reduce the amount by which toner is given triboelectricity during the preparatory rotation of the development sleeve; and/or the transfer current is increased to increase the amount by which toner is transferred from the photosensitive drum 1 onto the sheet S of recording medium. Any one of the above-described control methods is effective to prevent the fluctuation in image density, which is attributable to the changes in the amount of the triboelectricity of toner.

<Another Example of Image Forming Apparatus>

Figure 18:
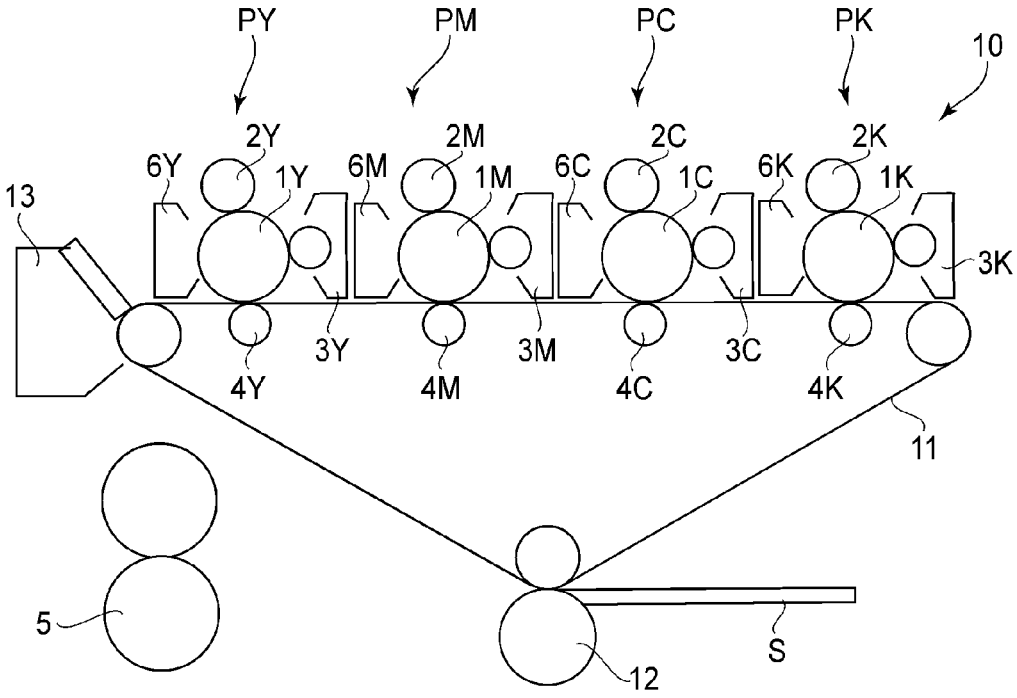
FIG. 18 is a schematic sectional view of another example of image forming apparatus to which the present invention is applicable, and shows the general structure of the apparatus.

Next, referring to FIG. 18, another example of image forming apparatus, to which the present invention is applicable, is described. In the case of the above-described embodiments of the present invention, the image forming apparatus was provided with only a single photosensitive drum on which an electrostatic latent image to be developed by a developing apparatus was formed. However, the application of the present invention is not limited to image forming apparatuses having only a single photosensitive drum. That is, the present invention is applicable also to full-color image forming apparatuses, such as the full-color image forming apparatus shown in FIG. 18, which has four photosensitive drums. Incidentally, the referential codes in FIG. 18, which are the same as those in FIG. 1, correspond to the components equivalent to those in FIG. 1.

The image forming apparatus 10 is an image forming apparatus of the tandem type, which has sequentially placed first to fourth image forming portions PY, PM, PC and PK for forming yellow (Y), magenta (M), cyan (C), and black (K) images, respectively. While an intermediary transfer member 11, which is in the form of an endless belt, is circularly moved in contact with each of the four image forming portions, in the direction indicated by an arrow mark in FIG. 11, monochromatic images, different in color, are layered on the intermediary transfer member 11, in alignment with each other, from the image forming portions. Then, the layered monochromatic images on the intermediary transfer member 11 are transferred onto the sheet S of recording medium to obtain an intended copy (print).

Next, the image forming operation of the image forming apparatus 10 structured as described above is described. As an image forming operation is started, the peripheral surface of the photosensitive drum 1Y, for example, which is for forming a yellow monochromatic image, is uniformly charged by a primary charging device 2Y. Then, the charged portion of the peripheral surface of the photosensitive drum 1Y is exposed to the beam of laser light projected from a laser-based exposing apparatus (unshown). As a result, an electrostatic latent image is formed on the peripheral surface of the photosensitive drum 1Y. Then, the electrostatic latent image is developed into a visible image, that is, an image formed of yellow toner, by a developing apparatus 3Y which uses yellow toner. Then, the yellow toner image is transferred (first transfer) onto the intermediary transfer member 11 by the function of the primary transfer bias applied to a transfer roller 4Y (first transferring member). Similarly, three more monochromatic toner images, different in color, are sequentially developed on the peripheral surfaces of the photosensitive drums 1M, 1C and 1K, by the second, third, and fourth image forming portions, one for one, and are sequentially transferred onto the intermediary transfer member 11. Thus, four monochromatic images, different in color, are layered in alignment on the intermediary transfer member 11, creating a single multilayer toner image on the intermediary transfer member 11.

Meanwhile, one of the sheets S of recording medium in a cassette (unshown) as a recording medium storage, is conveyed by recording medium conveying members (unshown) such as pickup rollers, recording medium conveyance rollers, registration rollers, etc., to the interface between the intermediary transfer member 11 and a second transfer roller 12 (second transferring member), in synchronism with the arrival of the layered toner images on the intermediary transfer member 11 at the interface. Then, the layered toner images are transferred all at once onto the sheet S of recording medium by the function of the second transfer bias applied to the second transfer roller 12. Thereafter, the sheet S of recording medium is separated from the intermediary transfer member 11, and is conveyed to a fixing apparatus 5, in which the toner images are fixed to the sheet S. Then, it is discharged from the image forming apparatus.

The toner particles, etc., remaining adhered to the peripheral surface of the photosensitive drum 1Y after the first transfer are recovered by a cleaner 6Y which is a cleaning apparatus. The toner particles, etc., remaining on the intermediary transfer member 11 after the second transfer are removed by an intermediary transfer member cleaner 13.

Among the photosensitive drums 1Y, 1M, 1C and 1K aligned in tandem in the color image forming apparatus, the photosensitive drum 1Y, which is the photosensitive drum on which a yellow toner image is formed, is closest to the fixing device 5, and the photosensitive drum 1K, which is the photosensitive drum on which a black toner image is formed, is farthest from the fixing device 5. Therefore, as an image forming operation continues, there grows a substantial amount of difference between the temperature of the developer in the developer container of the developing apparatus 3K which corresponds to the photosensitive drum 1K and the temperature of the developer in the developer container of the developing apparatus 3Y which corresponds to the photosensitive drum 1Y. Thus, in the case of an image forming apparatus such as the above-described image forming apparatus, at least the changes in the amount of the triboelectricity of the developer (toner) in the developing apparatus 3Y, and those in the developing apparatus 3K, have to be independently estimated from each other, and from those in the other developing apparatuses, in order to independently control the developing apparatuses 3Y and 3K from each other. As for the developing apparatuses 3M and 3C, they may be controlled based on the changes in the amount of the triboelectricity of the developer in the adjacent developing apparatuses (3Y and 3C, respectively), or the image forming apparatus may be structured so that the changes in the triboelectricity in the four developing apparatuses are independently estimated.

Thus, in the case of this example of image forming apparatus, each of the developing apparatuses 3Y, 3K (3M and 3C) is provided with the environment sensor 35, which is located as it was in each of the developing apparatuses in the preceding embodiments described above, so that the amount of the developer humidity in each developing apparatus can be accurately detected by the environment sensor 35 to estimate the amount of the triboelectricity of the developer in the developing apparatus. Since the image formation settings for each image forming portion are determined based on the amount of the triboelectricity of the toner in the corresponding developing apparatus, the image forming apparatus remains stable in image density; it is prevented from fluctuating in image density.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 255895/2009 filed Nov. 9, 2009 which is hereby incorporated by reference.

What is claimed is:

1. A developing apparatus comprising:

a developer container for accommodating a developer;

a rotatable developer carrying member, provided in an opening in said developer container, for feeding the developer to a position opposing an image bearing member to develop a latent image formed on the image bearing member;

a first chamber, provided in said developer container, for supplying the developer to said developer carrying member;

a second chamber, provided adjacent to said first chamber in said developer container;

a first feeding member, provided in said first chamber, for feeding the developer in said first chamber;

a second feeding member, provided in said second chamber, for feeding the developer in a direction opposite to a feeding direction of said first feeding member;

a partition member provided between said first chamber and said second chamber;

a partition opening provided in each of opposite ends of said partition member to form a circulation path between said first chamber and said second chamber; and a sensor, provided between said first feeding member and said second feeding member at a position facing one of said partition openings, for detecting information relating to temperature or moisture of the developer in said developer container.

2. An apparatus according to claim 1, wherein said sensor is disposed at one of the partition openings which is upstream with respect to the feeding direction of said first feeding member.

3. An apparatus according to claim 1, wherein said first chamber is disposed above said second chamber, and said sensor is disposed in a draw-up portion for drawing the developer up from said second chamber to said first chamber.

* * * * *